US010737370B2

(12) United States Patent
Gehling et al.

(10) Patent No.: US 10,737,370 B2
(45) Date of Patent: Aug. 11, 2020

(54) ADJUSTABLE TOOL

(71) Applicant: Goehl Technology, LLC, Oshkosh, WI (US)

(72) Inventors: Daniel J. Gehling, Ottawa Hills, OH (US); Steven C. Gehling, Oshkosh, WI (US)

(73) Assignee: Goehl Technology, LLC, Oshkosh, WI (US)

( * ) Notice: Subject to any disclaimer, the term of this patent is extended or adjusted under 35 U.S.C. 154(b) by 836 days.

(21) Appl. No.: 15/207,037

(22) Filed: Jul. 11, 2016

(65) Prior Publication Data

US 2018/0009088 A1 Jan. 11, 2018

(51) Int. Cl.
*B25B 13/32* (2006.01)
*B25B 13/50* (2006.01)

(52) U.S. Cl.
CPC ..... *B25B 13/32* (2013.01); *B25B 13/5075* (2013.01)

(58) Field of Classification Search
CPC ..... B25B 13/44; B25B 13/28; B25B 13/46; B25B 13/505; B25B 13/32; E21B 19/161
See application file for complete search history.

(56) References Cited

U.S. PATENT DOCUMENTS 168,406 A 10/1875 Ober
599,837 A * 3/1898 Harris
651,306 A 6/1900 Gabriel
877,773 A 1/1908 Holm
2,079,498 A * 5/1937 Douglas ..... H01R 43/0424 72/402
2,742,297 A * 4/1956 Bilz ..... B23B 31/12 279/66
2,787,180 A 4/1957 Fish
2,787,925 A * 4/1957 Buchanan ..... H01R 43/0424 72/402
3,209,624 A * 10/1965 Shiffman ..... G04D 1/10 81/6
3,664,213 A 5/1972 Knati
4,454,657 A * 6/1984 Yasumi ..... B21C 3/06 29/751
4,724,730 A 2/1988 Mader et al.
5,090,273 A 2/1992 Fossella
(Continued)

FOREIGN PATENT DOCUMENTS

WO WO9414573 7/1994
WO WO-2015096727 A1 * 7/2015 ..... B25B 13/463

*Primary Examiner* — Tyrone V Hall, Jr.
(74) *Attorney, Agent, or Firm* — Thomas D. Wilhelm; Stephen C. Jensen; Northwind IP Law, S.C.

(57) ABSTRACT

Adjustable-size jaw sub-assemblies, jaw assemblies made from such sub-assemblies, and tools, particularly hand tools, made using such jaw assemblies. A plurality of jaws are connected to a base ring by pivot pins. Cam follower recess can be defined at positions of the inner perimeter of the base ring, and between opposing faces of the base ring. In the jaw assemblies, an actuator, such as a cover plate, covers at least a portion of one of opposing faces of the base ring, and one or more bridges connect the jaws to the actuator. Movement of the base ring relative to the actuator causes the jaws to pivot about the pivot pin axes, with the jaws moving in concert with each other thereby to reduce or expand the size of a work opening defined by the jaws.

39 Claims, 16 Drawing Sheets

(56) References Cited

U.S. PATENT DOCUMENTS

| | | | | |
|---|---|---|---|---|
| 5,207,129 | A * | 5/1993 | Fossella | B25B 13/44 81/128 |
| 5,261,263 | A | 11/1993 | Whitesell | |
| 5,918,511 | A | 7/1999 | Sabbaghian et al. | |
| 6,073,522 | A * | 6/2000 | Carnesi | B25B 13/44 279/114 |
| 6,176,116 | B1 * | 1/2001 | Wilhelm | B25B 27/146 72/402 |
| 6,889,579 | B1 | 5/2005 | Brown | |
| 7,021,114 | B2 * | 4/2006 | Perreault | A61F 2/958 29/283.5 |
| 7,530,253 | B2 * | 5/2009 | Spenser | A61F 2/2412 72/402 |
| 7,992,470 | B2 | 8/2011 | Brown | |
| 8,402,863 | B2 | 3/2013 | Brown | |
| 8,833,209 | B2 * | 9/2014 | Brown | B25B 13/10 81/90.1 |
| 8,893,592 | B2 | 11/2014 | Womack | |
| 8,925,426 | B2 | 1/2015 | Shishkin | |
| 8,950,295 | B2 | 2/2015 | Chiang | |
| 8,984,990 | B2 * | 3/2015 | Broadaway | B25B 7/14 81/90.2 |
| 9,072,628 | B2 | 7/2015 | Gehling et al. | |
| 9,072,629 | B2 | 7/2015 | Gehling et al. | |

* cited by examiner

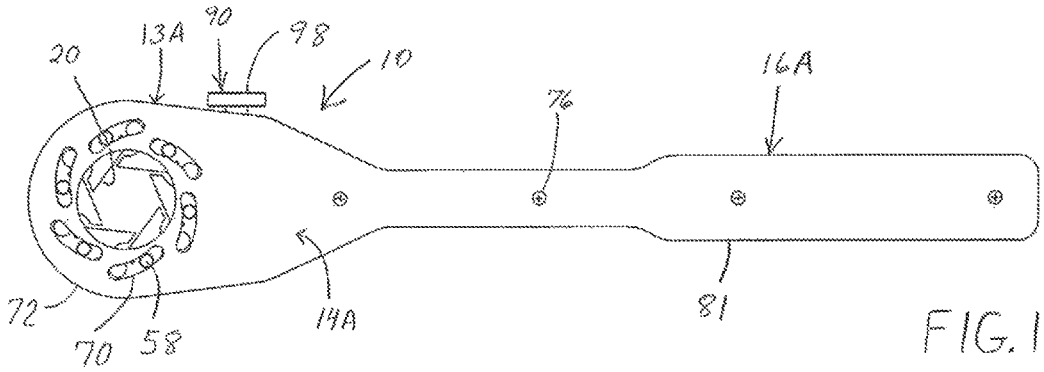
FIG. 1
FIG. 2
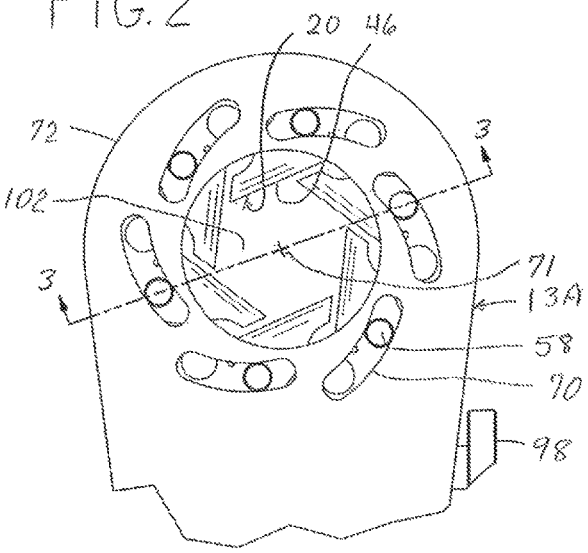
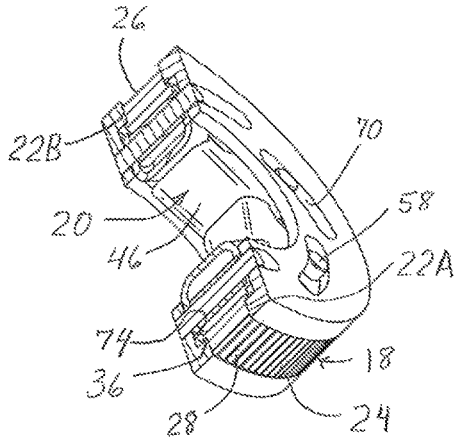
FIG. 4
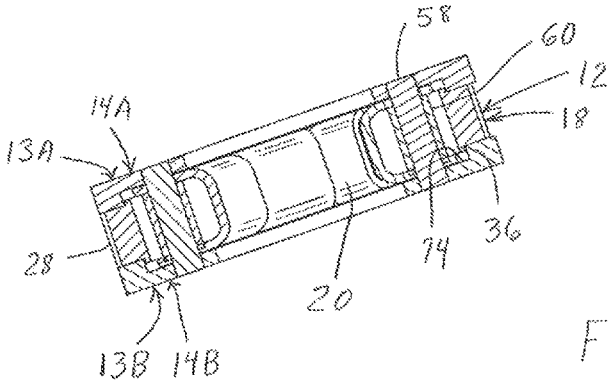
FIG. 3

ADJUSTABLE TOOL

BACKGROUND OF THE INVENTION

This invention relates to tools which are used to tighten and loosen work pieces which have screw-type threads, for example fasteners such as nuts, bolts, and screws, and threaded pipes. Such work pieces typically require a tool size and shape which corresponds to a size and shape of the work piece, or which is specifically configured to adapt to the size and shape of a given work piece.

Specifically, a wrench is specifically sized to a respective size and type of fastener. Accordingly, where multiple sizes of fasteners are used in an assembly comprised of various respective parts, multiple wrenches addressing the respective fastener sizes are provided at the respective work site, to fit and manipulate the corresponding fasteners.

Even skilled workers spend a significant portion of their work time selecting and retrieving appropriate-size wrenches needed to fit the respective size work pieces/fasteners. Where the size of the work piece is unknown, the worker may select various tools by trial and error before selecting the correct tool needed for the job of fitting the work piece thereby to tighten and/or loosen the work piece/fastener.

Such trial and error tool selection results in a significant amount of non-productive working time, required for the worker to complete the respective task.

Various types of adjustable open-end tools/wrenches are known for use in addressing a respective wide variety of types of fasteners. There are known, for example, two handle pliers-type devices which have adjustable jaws to fit multiple work piece sizes, for example and without limitation vice grips and channel lock pliers. Such open end tools necessarily engage less than all of the engageable surfaces on the respective work pieces.

Two-handle adjustable box end-type wrenches are also known, where the strength of the hand grip of the user determines the amount of force which is applied to engaging the surfaces of the fastener. But such adjustable wrenches have limited size adjustment, and typically engage substantially less than the entireties of respective ones of the surfaces of a given work piece, typically only a minor fraction of a given engageable surface of a work piece.

Two-handle tools/wrenches typically rely, for the power and dependability of the grip, of the working surfaces on the work piece, on the strength of the hand grip of the user, and/or may engage the surfaces of the work pieces using heavily toothed/faceted engagement surfaces. Accordingly, such two-handle tools tend to produce rapid wear on the surfaces of the work pieces so engaged, either by biting into the work piece work surfaces, or by slipping off the work piece surfaces.

Single handle open ended devices for engaging threaded fasteners and pipes are also known, such as pipe wrenches, crescent wrenches, and a wrench known as the "New Grip" wrench. Pipe wrenches and New Grip wrenches also have substantial facets/teeth on the gripping surface to assist in the task of gripping the work piece. As with the two-handle tools/wrenches, the faceted gripping surfaces affect substantial wear on the work pieces with which they are used.

Crescent wrenches have smooth work piece engaging surfaces, which engage only two opposing ones of the work piece surfaces; but such smooth engaging surfaces on the tool tend to slip off the respective two surfaces on the work piece if the worker is not especially diligent in setting the size of the wrench as the work piece is being engaged.

Accordingly, there is a need for a novel size-adjustable tool which can be adjusted, within a minimum and maximum size range, to reliably fit the size of a faceted work piece.

There is also a need for a such novel adjustable tool which can engage more than two of the work piece facets.

There is further a need for a such novel adjustable tool which can engage substantially the entirety of a working surface of a given work piece facet.

There is particularly a need for a such novel adjustable tool which can be easily sized and resized to engage multiple sized work pieces.

There is still further a need for a such novel adjustable tool which has a broad range of dimensional adjustability capacity.

There is also a need for a such novel adjustable tool which reliably maintains the selected size during application of the device to a work piece.

There is also a need for a such novel adjustable tool wherein the tool jaws are designed and configured to distribute the work forces applied by the tool in an even and symmetrically balanced manner to all of the surfaces of the work piece.

There is yet further a need for a such novel adjustable tool which maintains the contact surfaces of the tool engaged with the work piece during use without the need for the operator to apply gripping force to the jaws while using the so-adjusted tool to rotate a work piece.

There is also a need for a such novel adjustable tool which can simultaneously engage substantially the entirety of the working surface of each of the facets on the work piece.

These and other needs are alleviated, or at least attenuated, or partially or completely satisfied, by novel products, systems, and/or methods of the invention.

SUMMARY

This invention relates in general to adjustable-size jaw subassemblies, to jaw assemblies made from such subassemblies, and to tools, particularly hand tools, made using such jaw subassemblies and jaw assemblies. In the jaw subassemblies, a plurality of jaws are connected to a base ring by pivot pins. At least a portion of at least one of the jaws is disposed in a base ring aperture, inwardly of the outer perimeter of the base ring, and between opposing faces of the base ring. In the jaw assemblies, an actuator, such as a cover plate, covers at least a portion of one of opposing faces of the base ring, and one or more bridges connect the jaws to the actuator. Movement of the base ring relative to the actuator causes the jaws to pivot about the pivot pin axis whereby the jaws move in concert with each other thereby to reduce or expand the size of a work opening defined by the jaws.

Thus, in a first family of embodiments, the invention comprehends a jaw subassembly, adapted to be used as part of a jaw assembly, the jaw subassembly comprising a base ring, having first and second opposing faces, a first outer perimeter of the base ring extending between the first and second opposing faces, a base ring aperture being disposed inwardly of the outer perimeter, the base ring aperture having an inner perimeter; and a plurality of jaws, each jaw having a jaw base, and a jaw extension displaced from the respective jaw base, each jaw being connected to the base ring by a pivot pin such that the respective jaw pivot pin can pivot about the pivot pin axis, at least one cam follower recess being defined by portions of the inner perimeter of the base ring.

In some embodiments, the jaw extension comprises an engagement surface defining a plane "SP" that is parallel to the longitudinal axis of the central opening. Plane "SP" is also coincident with the engagement surface of each respective jaw extension. The engagement surfaces of the plurality of jaws collectively define an adjustable size jaw opening as an effective equi-angular polygon. A plane "JP" is parallel to plane "SP" and passes through the pivot axis of the corresponding first jaw. The first jaw has a remote end. A remote plane "RP" is parallel to the longitudinal pivot pin axis of a next adjacent second jaw and contacts that portion of the remote end of the first jaw that is most proximate plane "SP" of the jaw extension on the next adjacent second one of the jaws. The remote end of the first jaw is optionally parallel to jaw extension plane "SP" of the second jaw. A center to center plane "CP" passes through both the longitudinal axis of the central opening and the pivot axis of the first jaw. An angle "β" is defined between plane "JP" and the center to center plane "CP" of a respective jaw within a common perpendicular unnamed plane. A first such jaw has a jaw length "J" along the plane "JP" as the perpendicular distance from the pivot axis of the first jaw to the respective plane "RP" at the remote end of the same first jaw. A center to center distance "C" is the perpendicular distance between the longitudinal axis of the central opening and a jaw pivot pin axis of the first jaw. A width "w" is defined as the perpendicular distance between plane "JP" and the plane "SP" of the first jaw. A clearance distance "t" is defined as the perpendicular distance between plane "SP" of the jaw extension on a next adjacent second one of the jaws and that is proximate the remote plane "RP" of the first jaw according to the equation:

$$t = C\sin(60^\circ + \beta) - \frac{\sqrt{3}}{2}J - w.$$

In some embodiments, a plurality of cam follower recesses are defined by portions of the inner perimeter of the base ring.

In some embodiments, the jaw subassembly further comprises a plurality of pivot pin holes spaced about a circumference of the base ring and extending through the base ring from the first face to the second opposing face.

In some embodiments, a plurality of pivot pin recesses are defined by portions of the inner perimeter of the base ring, the pivot pin recesses being spaced about the inner perimeter and extending through the base ring from the first face to the second opposing face.

In some embodiments, the inner perimeter of the base ring further comprises a plurality of pivot pin recesses.

In some embodiments, the pivot pin recesses are alternately spaced between respective ones of the cam follower recesses.

In some embodiments the jaw assembly is adjustable between a minimum size jaw opening and a maximum size jaw opening, which enables the jaw assembly to be applied to any work piece having any size in a range between the minimum size jaw opening and the maximum size jaw opening, the plurality of jaws thus defining an adjustable size jaw opening, the jaw assembly further comprising an actuator covering at least a portion of one of the first and second opposing faces of the base ring, and extending about, and generally outwardly from, at least a portion of the inner perimeter of the base ring aperture; one or more bridges connecting the jaws to the actuator, the actuator comprising a plurality of elongate cam slots, the one or more bridges comprising respective one or more cam followers connecting the jaws to the cam slots by a slidable interaction between a cam follower and the actuator along one of the elongate cam slots, thus defining a work opening range that is at least a portion of the jaw opening range, such that movement of the base ring relative to the actuator causes the jaws to pivot about the pivot pin axes of the respective pivot pins such that the jaw extensions move in concert with each other, generally inwardly thereby reducing the size of the work opening, or generally outwardly thereby expanding the size of the work opening; and a controller adapted to move the base ring about the central axis and relative to the actuator from a first position to a second position, thereby to cause the jaws to pivot inwardly or outwardly thereby to adjust the size of the work opening, and to hold the base ring in the second position.

In some embodiments, the actuator is defined in at least one cover plate, the jaw assembly comprising "n" jaws, and the one or more bridges comprising "n" bridges connecting the jaws to the at least one cover plate.

In some embodiments, the actuator covers at least a portion of the jaw base of each jaw.

In some embodiments, the plurality of jaws comprises "n" jaws, and the one or more bridges comprising "n" bridges, each bridge connecting a different jaw to the actuator.

In some embodiments, the jaw assembly further comprises teeth in the outer perimeter of the base ring, the controller comprising an adjusting screw engaging the teeth, optionally directly engaging the teeth.

In some embodiments, the jaw assembly further comprises a second actuator covering the other of the first and second faces of the base ring, and extending about, and generally outwardly from, at least a portion of the inner perimeter of the base ring aperture.

In some embodiments, the jaw assembly further comprises a bridge interfacing with a jaw between the respective jaw base and the respective jaw extension.

In some embodiments, the jaw assembly further comprises a plurality of elongate cam slots in the actuator, the one or more bridges comprising respective one or more cam followers connecting the jaws to the cam slots.

In some embodiments, a range of motion of the jaws has an adjustability ratio, of maximum jaw work opening to minimum jaw work opening, greater than 1/1, optionally greater than 1.5/1, optionally at least 2/1. In some embodiments, the pivot pin is an integral element of a respective one of the jaws.

In some embodiments, a given one of the pivot pin recesses has a main body, and a neck, a minimum dimension "N" across the neck is less than a maximum dimension "D" of the pivot pin recess across the main body perpendicular to a line which passes through the neck and bisects both the neck and the main body into equal portions.

In some embodiments, a center line passes from an interior of the pivot pin recess through a pivot pin axis of a pivot pin which closely fits the pivot pin recess and which center line also passes through the neck of the pivot pin recess, and bisects both the pivot pin recess and the neck into equal portions, thereby defining an angle α of at least 10 degrees with the center to center distance, defined from the longitudinal axis of the central opening of the base ring, to the intersection with the pivot pin axis in the pivot pin recess of a respective jaw.

In some embodiments, the jaws are arranged to rotate synchronously about the respective jaw pivot axes, whereby said jaws cooperate with each other between the maximum and minimum size work openings.

In some embodiments, the tool comprises a single handle extending from the jaw assembly, and a rotating drive of the adjusting screw extends from the single handle.

In some embodiments, the tool comprises a second actuator covering at least a portion of the other of the first and second faces of the base ring, and extending about an entirety of the base ring aperture, and extending generally outwardly from the inner perimeter of the base ring aperture, the single handle comprising extensions of the first and second actuators extending in one or more common directions from the jaw assembly, at least one handle spacer being disposed in the handle between the extensions of the first and second actuators.

In some embodiments, the tool further comprises a second over plate, the first and second cover plates overlying the first and second opposing faces of said base ring, first and second actuators are defined in first and second head sections of the first and second cover plates, the extensions of the first and second actuators comprising first and second handle elements of the first and second cover plates, the first and second handle elements being secured to each other, with the at least one handle spacer between the first and second handle elements, in at least first and second locations spaced from each other so as to generally prevent movement of the first and second cover plates and the handle spacer relative to each other during use of the tool.

In some embodiments, the tool further comprises a second actuator covering at least a portion of the other of the first and second faces of the base ring, the first and second actuators being defined in first and second head sections of first and second cover plates, the single handle comprising first and second handle elements of the first and second cover plates, extending from the first and second head sections, and at least one handle spacer disposed between the first and second handle elements, the at least one handle spacer confining the adjusting screw against the teeth of the gear at the outer perimeter of the base ring.

In some embodiments, the tool has a maximum outside tool dimension defining a workspace at the head section exclusive of any contribution of the handle, a ratio of the maximum outside tool dimension to the maximum size of the work opening, measured as the diameter of a circle inscribed within the effective equi-angular polygon formed by the engagement surfaces of the jaw array of no greater than 2.75/1.

In some embodiments, the controller is adapted to being manipulated by a user's hand while the same hand is used to simultaneously hold the tool.

BRIEF DESCRIPTION OF THE DRAWINGS

Illustrative embodiments of the invention are described hereinafter, by way of example only, with reference to the accompanying drawings, wherein:

FIG. 1 is a plan view of a first embodiment of a hand tool of the invention.

FIG. 2 is an enlarged view of the jaw assembly of the hand tool of FIG. 1.

FIG. 3 is a cross-section of the jaw assembly of FIG. 2 taken at 3-3 of FIG. 2.

FIG. 4 is a pictorial perspective of a cross-section of the jaw assembly of FIG. 2, the cross-section being taken at 3-3 of FIG. 2.

Figure 5:
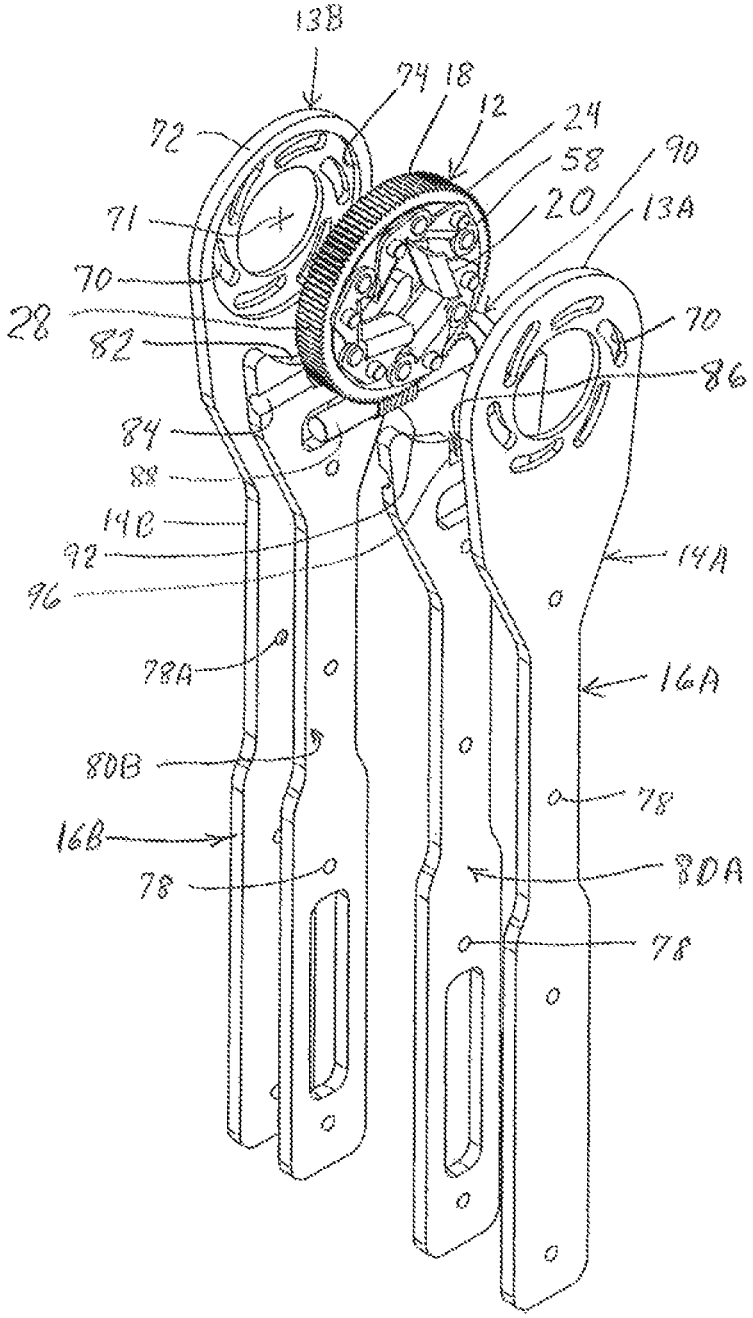
FIG. 5 is an exploded view of the hand tool of FIG. 1.

The invention is not limited in its application to the details of construction, or to the arrangement of the components or to the methods of construction, set forth in the following description or illustrated in the drawings. The invention is capable of other embodiments or of being practiced or carried out in various other ways. Also, it is to be understood that the terminology and phraseology employed herein is for purpose of description and illustration and should not be regarded as limiting. Like reference numerals are used to indicate like components.

DETAILED DESCRIPTION OF THE ILLUSTRATED EMBODIMENTS

FIGS. 1-5 illustrate a first embodiment of an adjustable tool 10 of the invention. Tool 10 has a jaw subassembly 12 held between head sections 13A, 13B of first and second overlying cover plates 14A, 14B. Handle elements 16A, 16B of the cover plates extend away from the jaw subassembly and thus away from the respective head sections.

Jaw subassembly 12 includes a base ring 18 and a plurality of jaws 20 mounted to the base ring.

Figure 6:
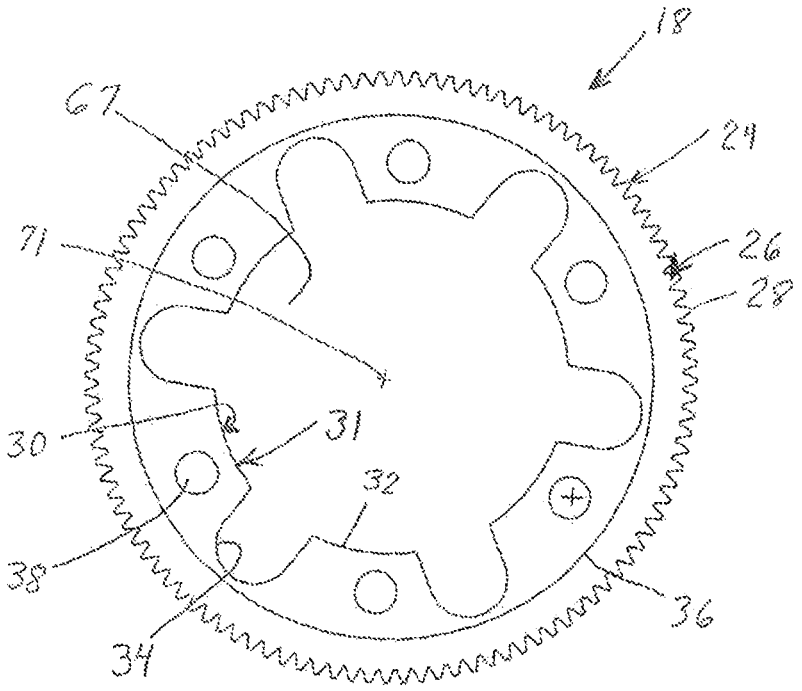
FIG. 6 is a pictorial view of the base gear used in the jaw assembly of the hand tool of FIGS. 1-5.
Figure 15:
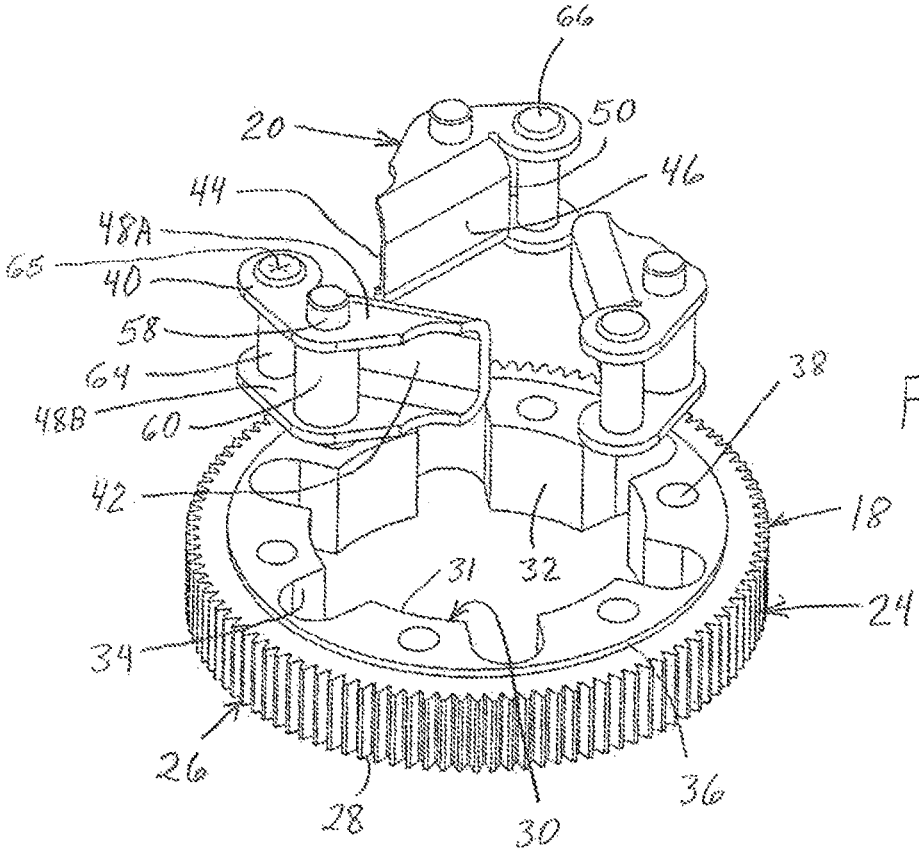
FIG. 15 is a pictorial view of the base gear, used in the jaw subassembly of FIG. 14, with the jaws, pivot pins, and cam followers shown as separate subassemblies displaced from the base gear.

Referring to FIGS. 3-6 and 9-12, base ring 18 has first and second opposing faces 22A and 22B, and an outer perimeter 24 extending between the opposing faces. A ring gear 26, including teeth 28, extends about at least that portion of the circumference of outer perimeter 24 which is directed toward handle elements 16A, 16B in the assembled tool. An inner perimeter 30 defines an interior surface of base ring 18 and a corresponding central base ring aperture through the base ring. Referring to FIGS. 6 and 15, inner perimeter 30 defines a minor diameter 31 which functions in part as a plurality of jaw support surfaces 32. A plurality of cam follower recesses 34, at least as great in number as the number of jaws, extend from the minor diameter toward, but stop short of, outer perimeter 24.

The thickness of base ring 18 between the first and second opposing faces 22A, 22B is stepped down at steps 36 which are disposed between cam follower recesses 34 and outer perimeter 24 on each of the opposing faces. Steps 36 can be intermittent or can extend continuously about the full annulus defined by the base ring, such that the portions of faces 22A, 22B which are disposed outwardly of steps 36 are closer to each other than the portions of faces 22A, 22B which are disposed inwardly of steps 36. Pivot pin holes 38 extend through base ring 18 between the inner perimeter and the outer perimeter, and between respective ones of the cam follower recesses 34.

Figure 7:
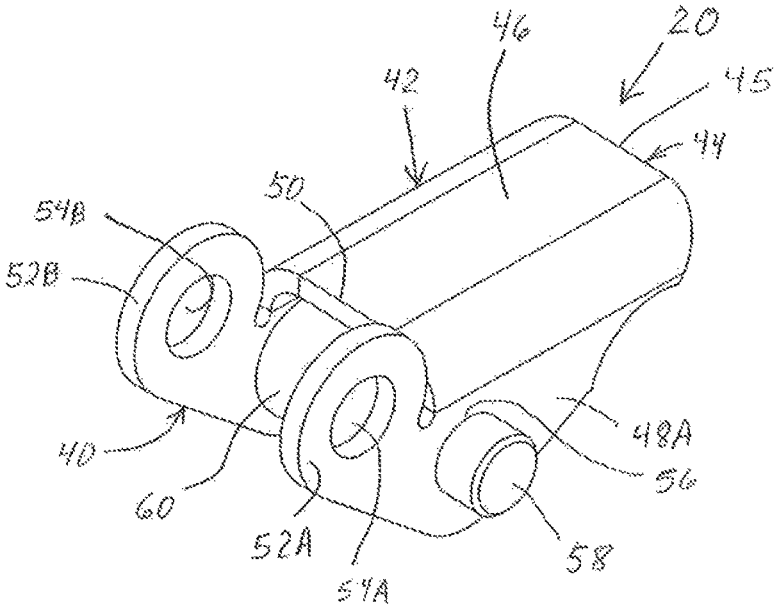
FIGS. 7 and 8 are pictorial views of the jaws shown in the hand tool of FIGS. 1-5.
Figure 8:
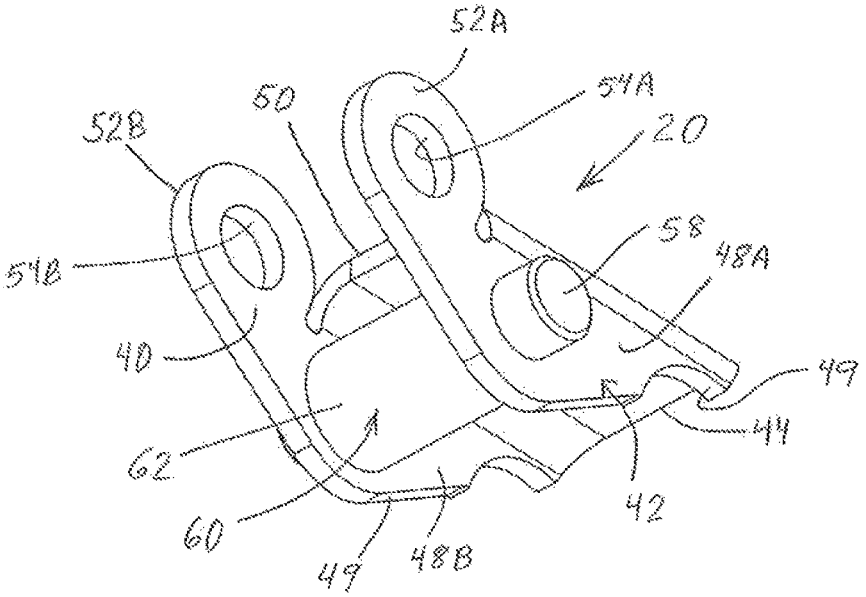
Figure 9:
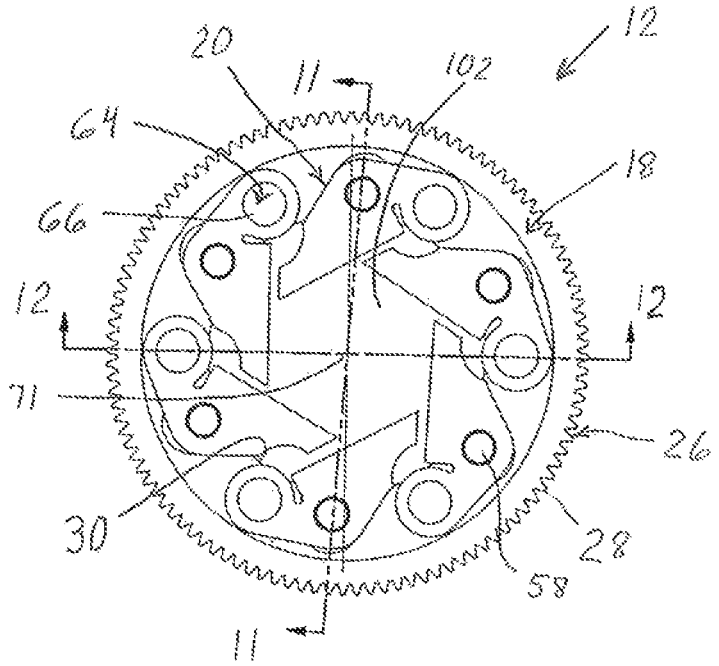
FIG. 9 is a plan view of the jaw subassembly used in the hand tool of FIGS. 1-5.
Figure 10:
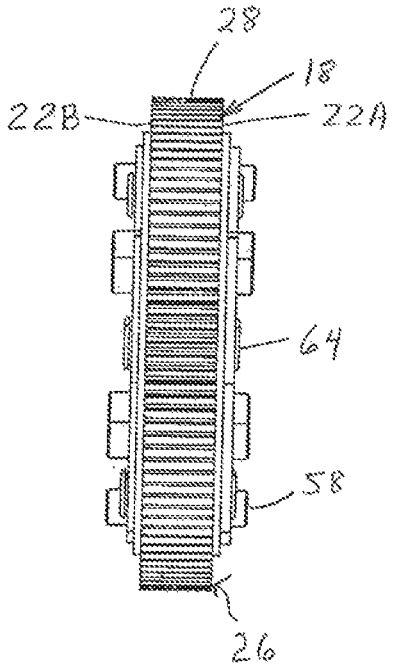
FIG. 10 is a side elevation view of the jaw subassembly of FIG. 9.
Figure 11:
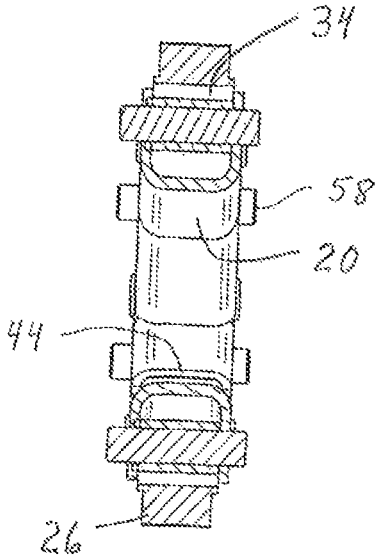
FIGS. 11 and 12 are cross-sections of the jaw subassembly of FIG. 9, taken at 11-11 and 12-12 respectively.
Figure 12:
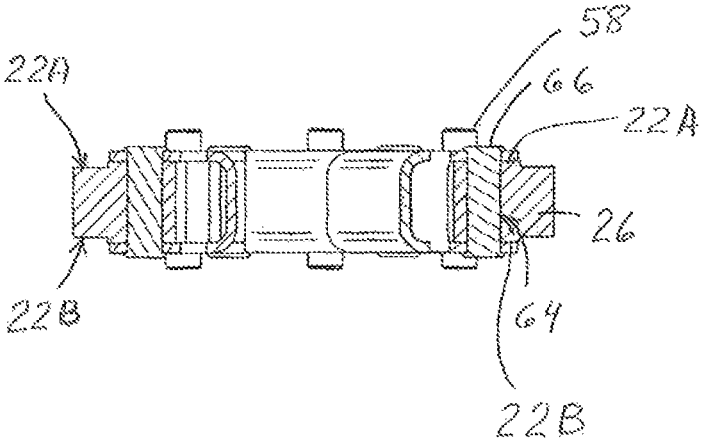

Turning now to FIGS. 7 and 8, a respective jaw 20 has a jaw base 40, and a jaw extension 42 extending to a remote end 44 having a remote edge 45 of the jaw.

In the illustrated embodiment, jaw extension 42 includes an engagement surface 46 which engages work pieces which are to be manipulated by the tool 10, and first and second side walls 48A, 48B which extend from the engagement surface on opposing sides of the engagement surface. Side walls 48A, 48B extend longitudinally along the length of the jaw extension, from locations at or proximate remote end 44 to locations at or proximate a proximal end 50 of engagement surface 46; and extensions of the first and second side walls extend downwardly to terminal edges thereof thus to define first and second wings 52A, 52B of the jaw, and the bottom 49 of the jaw extension.

At least a portion of the jaw engagement surface 46 can have any texture or configuration such as flat, contoured, smooth, toothed or serrated, or a combination thereof. Jaw 20 can be adapted with a rotary cutting surface such as is used for tube cutting, or can be adapted to fit a wide variety of workpieces including pipes, tubes, and faceted fasteners.

A first pair of pivot pin apertures 54A, 54B extend through wings 52A, 52B of the jaw base, to receive a pivot pin, the structure and role of a such pivot pin in apertures 54A, 54B being described hereinafter. A second pair of cam follower apertures 56 extend through side walls 48A, 48B between pivot pin apertures 54A, 54B and the remote end 44 of the jaw and are adapted to receive a cam follower 58, which is illustrated in FIGS. 7 and 8 as a cylindrical pin 58.

A cam follower sleeve 60, having an exterior surface 62 and an opposing interior surface, is mounted to the cam follower pin as the cam follower pin is being mounted on the jaw, and extends between wings 52A, 52B. Pin 58 can be attached to mounting sleeve 60 by any suitable method such as incorporating a pin with an interference fit, adhesive bonding, welding, brazing, soldering, or various fasteners such as screws and threads, rivets, or any other method to secure the cam follower sleeve to the cam follower pin to prevent longitudinal movement of the cam follower pin relative to the jaw whereby the cam follower pin is securely mounted to the respective jaw as illustrated in FIGS. 7 and 8.

In the jaw subassembly embodiment illustrated in FIGS. 9-12, six jaws 20 are mounted to base ring 18 by respective six pivot pins 64. A pivot pin 64 extends through a respective pivot pin hole 38 in the base ring, and through pivot pin apertures 54A, 54B in wings 52A, 52B of the jaw base. Opposing ends of the respective pivot pin extend only a minimal distance outwardly beyond apertures 54A, 54B, and are terminated in expanded-diameter heads 66 (FIG. 12), for example rivet-type heads flattened against wings 52A, 52B about apertures 54A, 54B.

Cam follower pin 58 and cam follower sleeve 60, when so mounted to a jaw, are received in a respective cam follower recess 34 in the base ring. As illustrated in e.g. FIGS. 10-12, pivot pins 64 extend only minimal distances beyond faces 22A, 22B of the base ring, while the cam follower pins extend further, beyond the ends of the pivot pins, thus to engage respective cams in cover plates 14A, 14B which are described hereinafter, while clearances between pivot pins 64 and cover plates 14A, 14B avoid frictional engagement between pivot pins 64 and cover plates 14A, 14B.

With the jaw so mounted to the base ring, for pivotation with respect to a such pivot pin hole 38, the jaw, and thus the jaw engagement surface, is capable of pivoting, from a fully open position, where the cam follower is fully deployed into cam follower recess 34, to a fully closed position where the jaw, and thus the engagement surface 46 of the jaw, is deployed to the maximum extent possible away from the surfaces of the cam follower recess.

As illustrated in the drawings, in jaw subassembly 12, a plurality of jaws 20 are mounted to base ring 18. Any number of two or more jaws can be mounted to the base ring in a given tool. The number of jaws mounted to the base ring depends in part on the configuration of the work pieces to which the tool is expected to be applied. For a simple tool, as few as two jaws can be mounted to the base ring, with the engagement surfaces opposing each other because most nuts, headed bolts, and headed screws have facets on opposing sides of the respective fastener/work piece, and most work pieces/heads are 4-sided/4-faceted or 6-sided/6-faceted. Since the majority of the work pieces are 6-sided, the tool can successfully engage the head even if the tool has only 2 jaws. Similarly, the tool can successfully engage the head if the tool has 3 jaws, namely engaging every other facet on a six-faceted/six-sided work piece head. In the example illustrated in FIGS. 1-5, six jaws are arranged about the perimeter of the base ring whereby the tool can simultaneously engage all six facets of a six-sided/six-faceted nut, bolt, screw, or other work piece.

Each jaw is thus mounted to the base ring at a pivot pin hole 38 by a pivot pin 64 which extends through hole 38 in the base ring, and apertures 54A, 54B in the wings 52A, 52B of jaw base 40. With the jaw thus mounted to the base ring as illustrated in the drawings, with the engagement surface 46 of the jaw facing into the central aperture 67 which extends through the base ring at and inwardly of minor diameter 31, as the jaw is caused to pivot about the mounting location at pivot pin 64, the respective cam follower pin 58, and the corresponding cam follower sleeve 60, move into, and outwardly of, the respective cam follower recess 34 in the base ring. Accordingly, all of the plurality of jaws move/pivot about the pivot pin axes 65 of their respective pivot pins 64.

Movement of a respective jaw about its respective pivot pin 64 is controlled by engagement of the respective cam follower pin 58, as a bridge, or bridging member, in a corresponding cam slot 70 in the respective one of head sections 13A, 13B of cover plates 14A or 14B. The cam follower pin serves as a bridge between the movement of the base ring and pivoting of the respective jaw about the corresponding pivot pin axes 65 of the respective pivot pins 64 as base ring 18 rotates about its central axis 71. Similarly, head sections 13A, 13B serve as actuators by means of cam slots 70 whereby rotation of jaws 20 is actuated by the interaction of the bridging members in cam slots 70 as base ring 18 is rotated about central axis 71.

As illustrated in e.g. FIGS. 1-5, adjacent base ring 18, each cover plate 14A, 14B has a first thickness at its outer edge 72, and a stepped recess 74 having a lesser thickness at a location displaced inwardly from outer edge 72. In the assembled jaw assembly, step recess 74 is generally aligned with a step 36 in the corresponding face 22A or 22B of base ring 18. Accordingly, in the assembled jaw assembly, the respective steps 36 and 74 maintain the base ring in axial alignment with the cover plates such that the cam follower pins 58 in jaws 20 are maintained in proper alignment with cam slots 70 in the respective cover plates.

Still referring to FIGS. 1-5, each head section 13A, 13B of cover plate 14A, 14B has six of the arcuate cam slots 70 evenly spaced about the circumference of the respective cover plate, and jaw subassembly 12 has six jaws, correspondingly six cam follower pins 58 extending into, optionally through, the respective six cam slots in each of the head sections.

In the assembled tool, the jaw subassembly is positioned between the two cover plates 14A, 14B, with the cam follower pins mounted in the respective jaws and extending into the respective cam slots of the cover plates.

Screws 76 extend through screw holes 78 in handle 16A, through corresponding screw holes in handle spacers 80A, 80B, and are drawn tight by threads in respective threaded holes 78A in handle 16B.

Any fastener type such as rivets, pins, or other fastening means such as welding, bonding, brazing, or soldering can be used to draw together the various handle elements as a single secure unit to thereby define the unitary structure of tool handle 81.

Given that the two handle elements 16A, 16B are rigid extensions of the rigid respective cover plates, the drawing of the two handle elements to each other, with intervening handle spacers, draws the handle elements and the handle spacers together as a single secure unit to thereby define the tool handle 81. Such drawing together of the handle elements also draws the cover plates toward each other and into working engagement with the jaw subassembly as the steps 36 and 74 become operably engaged with each other.

Figure 13:
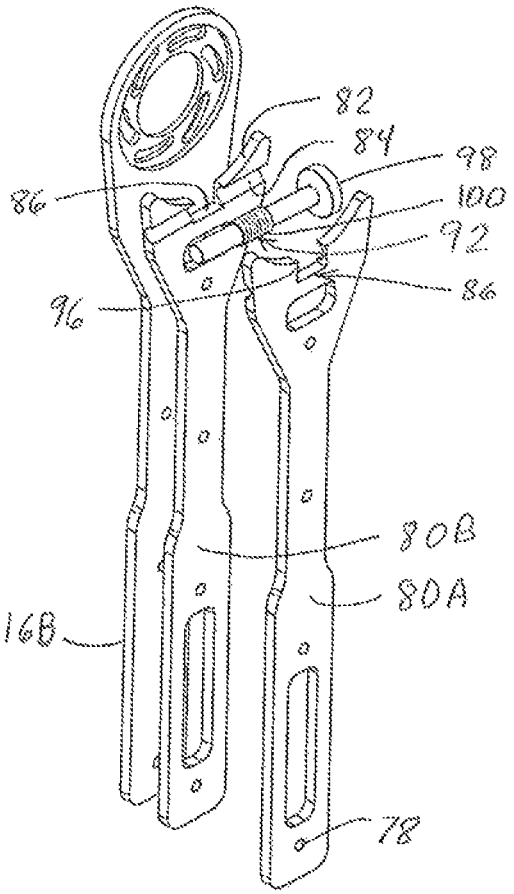
FIG. 13 is an exploded pictorial view showing the two handle inserts, the adjusting screw, and one of the cover plates, from the embodiment of FIG. 1.

As illustrated in FIGS. 5 and 13, the profiles of handle spacers 80A, 80B generally correspond to the profiles of handle elements 16A, 16B. Ends 82 of the handle spacers, which are adjacent base ring 18, extend generally parallel to a portion of outer perimeter 24 of base ring 18.

Figure 27:
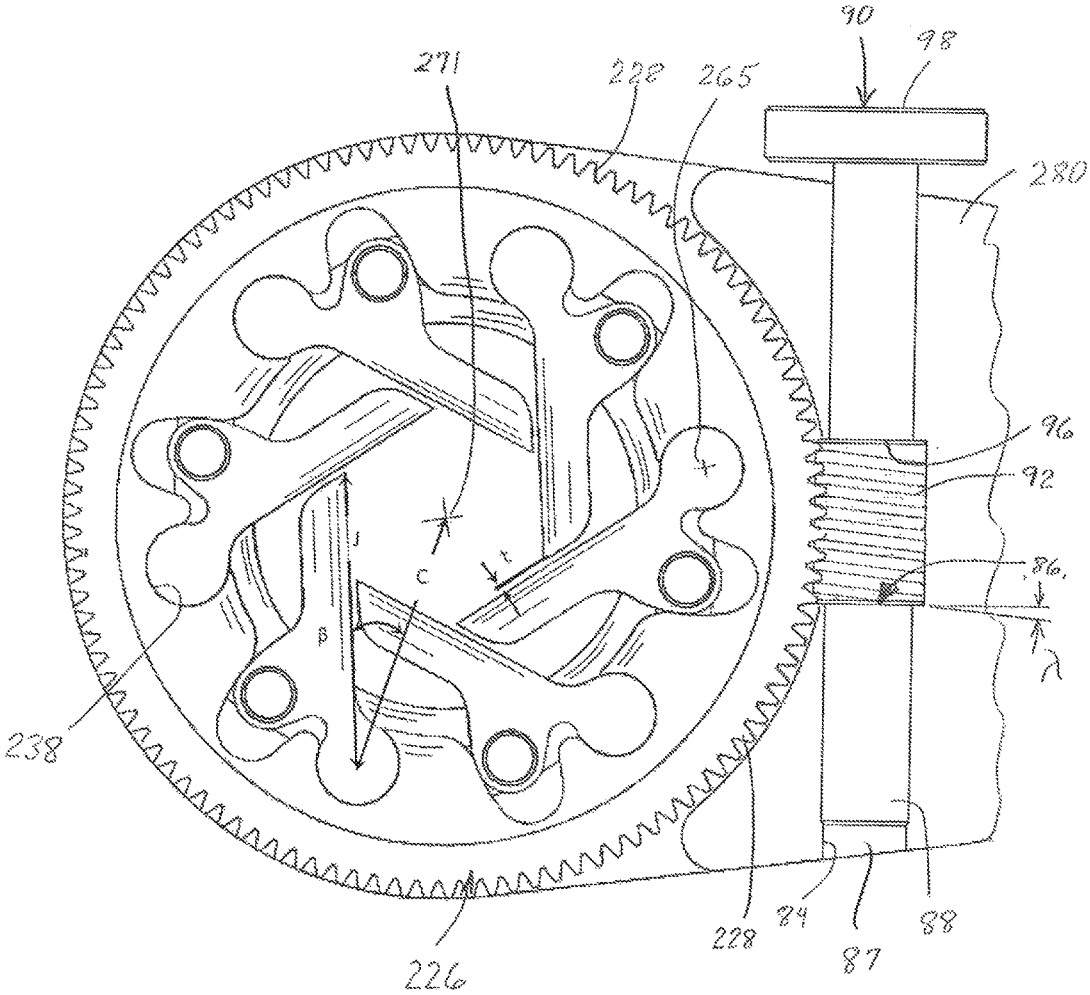
FIG. 27 shows a jaw assembly as in FIGS. 18-20 and 24-26, with the aperture about ½ and showing some of the dimensions representative of the equation for distance "t" between the end of one jaw and the face of an adjacent jaw.

Handle spacers 80A, 80B have respective recesses 84 and notches 86. When handle spacers 80A, 80B are in facing, touching relationship with each other, with semi-circular elongate recesses 84 aligned with, overlying/underlying each other, in the assembled handle, the combination of the recesses defines a generally circular/cylindrical elongate cavity 87, open on both ends (FIG. 27). Cavity 87 extends from one of the sides of the handle into the interior of the handle through the handle spacers. In the illustrated embodiments, cavity 87 extends the full width of the handle spacers, from a first side to the second opposing side. Cavity 87 receives a shaft 88 of a controller 90 which extends outwardly from the respective outer side of the handle, and inwardly into and through a portion of the handle, to an engagement location where a threaded portion 92 of the controller engages the teeth 28 of the base ring.

Notches 86 in the handle spacers receive the threaded portion of shaft 88. The diameter of threaded portion 92, as defined by the maximum diameters at the peaks of respective circumferential threads, is greater than the diameter of elongate cavity 87. Accordingly, once the handles and handle spacers are assembled to each other, the threaded portion of shaft 88 is captured against longitudinal movement of the shaft, by edges 96 of notches 86.

With the threaded portion captured against longitudinal movement of the shaft, rotation of a thumbwheel 98 of controller 90, which is attached to shaft 88, rotates threads 100 of the threaded portion 92 against teeth 28 of the base ring, thus rotating the base ring, which is held radially stationary relative to cover plates 14A, 14B by steps 36, 74, about its longitudinal axis 71. Teeth 28 can be any suitable protuberance on the outer perimeter 24 capable of imparting controlled rotational motion to the base ring via cooperation with threads 100, including various combinations and configurations of gear teeth such as helical, spur, worm, or bevel. Protuberances such as pins and knurled surfaces are also contemplated.

The rate of rotation of the base ring depends on the lead angle "$\lambda$", of threads 100 which references from a line that is perpendicular to the longitudinal axis of controller 90. Referring to FIG. 27 the lead angle of threads 100 can be of any suitable angle, but is preferably chosen to be a self-locking thread pitch. A gear set is said to be self-locking when the gear teeth 28 cannot drive the threads 100. Generally this condition is obtained when the lead angle of the threads 100 is less than the friction angle, "$\phi$", and thereby resists counter rotational forces on shaft 88 to increase opening 102 during the rotational engagement of the jaws 20 with the work piece 104. The friction angle is found by the relationship $\tan \phi = \mu_s$, where $\mu_s$ is the coefficient of static friction of the contacting surfaces of threads 100 and gear teeth 28. Based upon generally accepted values of the coefficient of static friction, the self-locking condition occurs when $\mu_s > \tan \lambda$ and represents the friction angle under ideal static conditions. However, the friction angle will vary with such static factors as surface finish and lubrication, or be affected by dynamic factors such as the motion and vibration of the tool during use which may upset the static condition.

As the base ring is rotated, jaws 20, which are mounted to the base ring by pivot pins 64, are also caused to rotate. As the jaws move along the direction of rotational movement of the base ring, cam follower pins 58 in the respective jaws engage the respective cam slots 70 in cover plates 14A, 14B. As the cam follower pins engage the cam slots according to the rotation of the base ring, the jaws are caused to pivot about their pivot pin axes 65 of their respective pivot pins 64. Such pivoting of the jaws results in concerted, simultaneous movement of the respective jaw extensions, thus the jaw engagement surfaces, toward, or away from, the central axis of opening 102, which corresponds with central axis 71 of the base ring.

Cavity 87 can as well extend from the top or bottom of the handle, into the interior of the handle. In such embodiments, threaded portion 92 of shaft 88 is replaced with e.g. a gear which engages teeth 28 of the base ring.

The direction of movement of the jaws, toward or away from central axis 71, depends on whether the thumbwheel is turned clockwise or counter-clockwise. Thus, as the thumbwheel is turned one direction, opening 102 becomes larger. As the thumbwheel is turned in the opposite direction, opening 102 becomes smaller.

Tool 10 is employed by first using the thumbwheel to adjust the size of opening 102 such that opening 102 is larger than a work piece 104, e.g. nut, bolt, screw (FIG. 14), to be turned. The tool is then positioned on the work piece such that opening 102 of the tool extends about the work piece, with the work piece in opening 102. With the tool thus extending about the work piece, the thumbwheel is turned, adjusted, and the tool is turned as needed about the rotational axis of the work piece, to reduce the size of opening 102 so as to match the size of the work piece and to align engagement surfaces 46 of the jaws with the facets of the work piece. In so doing, the size of opening 102 is adjusted to generally match the size of the work piece. With the size of the tool thus adjusted to match the size of the work piece, the tool now grips the work piece. The tool can then be rotated about the axis of rotation of the work piece, thus effecting rotation of the work piece, and corresponding advancement or withdrawal of the work piece threads into or out of a corresponding article with which the work piece is engaged.

As the work on a second work piece of a different size is contemplated, the size of opening 102 can be adjusted to fit the size of the second work piece, without the need to determine the actual size of the second work piece, without the need to search for, find, select, or secure a second tool.

In the embodiment illustrated in e.g. FIGS. 9-12, the jaws overlap each other. Namely, the remote end 44 of each jaw overlaps the engagement surface 46 of one of the next adjacent jaws. Where the jaws thus overlap each other, pivoting movement of any one jaw at a time is limited by the fact that even a small movement of the one jaw toward central axis 71 brings that jaw into an abutting relationship with the remote edge 45 of remote end 44 of one of the next adjacent jaws. However, if all of the jaws pivot by the same amount at the same time, thus the jaws move together in concert, a clearance distance "t" (FIG. 27), equal to or greater than zero, is maintained through the full range of pivotation, namely the jaws adjusting the size of the opening 102 which is collectively defined by the jaws.

With a clearance distance "t" thus being maintained between each pair of next adjacent jaws over the full range of adjustment motion of the jaws while the jaws are moving simultaneously, in concert with each other, the size of the opening defined by the jaws can be adjusted to any size, over a range of sizes from a minimum size to a maximum size, thus to be adjusted to the specific size of a work piece, such as a nut, a bolt, or a screw, to which the tool is to be applied.

Figure 14:
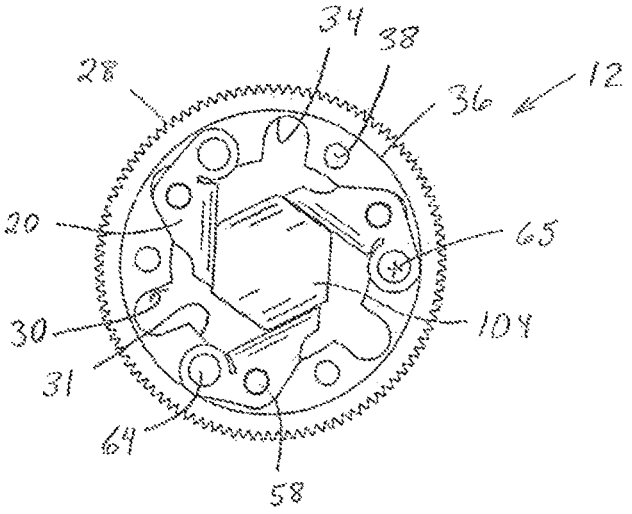
FIG. 14 is a plan view of a jaw subassembly of a second embodiment as in FIG. 9, but using only three jaws.

FIGS. 14 and 15 illustrate a second embodiment of the jaw subassembly, using the base ring of FIG. 6, but employing only three jaws. By employing only three jaws, the jaw extensions can be more elongated if desired, and the tool can still engage a six-faceted work piece as illustrated at 104 in FIG. 14. With use of only three jaws, cover plates 14A, 14B can employ 6 cam slots 70 as in the embodiment of FIGS. 1-13, or can embody only 3 cam slots 70.

Figure 16:
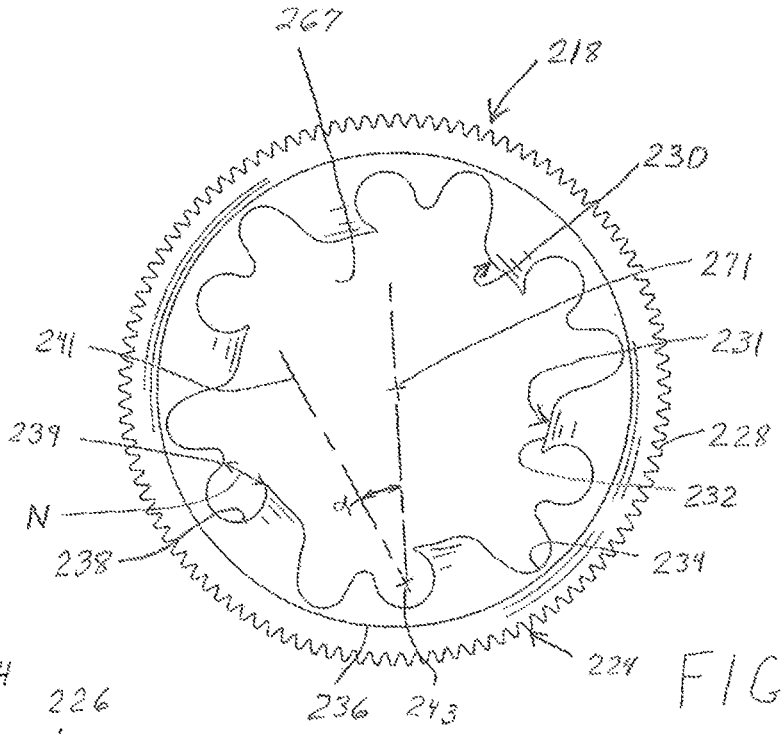
FIG. 16 is a plan view of a base ring used in a third embodiment of the jaw subassembly of tools of the invention.
Figure 17:
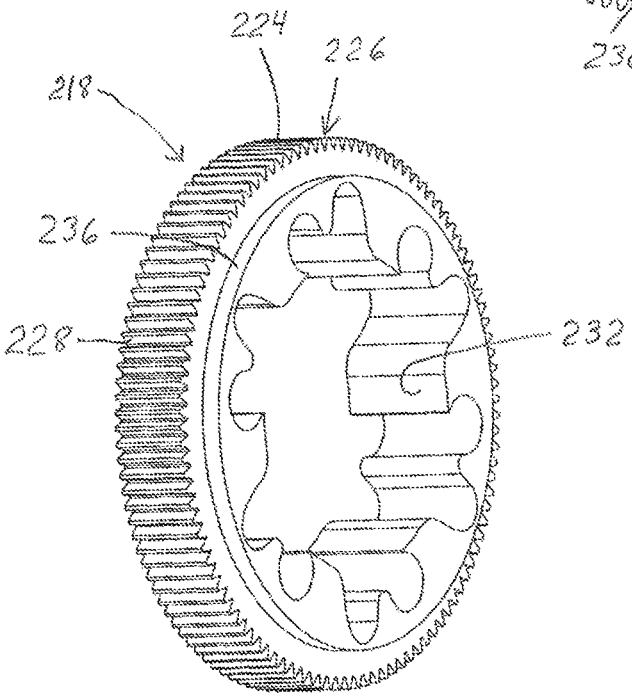
FIG. 17 is a pictorial view of the base ring of FIG. 16.

FIGS. 16-27 illustrate a third embodiment of tools of the invention. FIG. 16 shows the base ring 218 in plan view. FIG. 17 shows the same base ring in a pictorial view.

Base ring 218 has first and second opposing faces 222A and 222B, and an outer perimeter 224 extending between the opposing faces. A ring gear 226, including teeth 228, extends about at least that portion of the circumference of outer perimeter 224 which is directed toward handle 216 in the assembled tool 200.

An inner perimeter 230 defines an interior surface of base ring 218 and a corresponding central aperture 267 through the base ring. Referring to FIGS. 16 and 17, inner perimeter 230 defines a minor diameter 231 which functions in part as a plurality of jaw support surfaces 232. A plurality of cam follower recesses 234, at least as great in number as the number of jaws, extend from the minor diameter toward, but stop short of, outer perimeter 224.

The thickness of base ring 218 between the first and second opposing faces 222A, 222B is stepped down at steps 236 which are disposed between cam follower recesses 234 and outer perimeter 224 on each of the opposing faces. Steps 236 can be intermittent or can extend continuously about the full annulus defined by the base ring, such that the portions of faces 222A, 222B which are disposed outwardly of steps 236 are closer to each other than the portions of faces 222A, 222B which are disposed inwardly of steps 236.

Pivot pin recesses 238, at least as great in number as the number of jaws, extend from the minor diameter toward, but stop short of, outer perimeter 224, and are located between respective ones of the cam follower recesses 234. Each pivot pin recess has a neck 239 at or proximate the minor diameter. Referring to FIG. 16, neck 239 has a lesser dimension "N" across than the maximum dimension "D" across a main body of the recess at a location between neck 239 and outer perimeter 224. A center line 241 passing from the pivot pin axis 243 of the pivot pin recess through neck 239, and bisecting both the recess and the neck, namely dividing the recess and the neck, into two equal portions, defines an angle $\alpha$ of at least 10 degrees, optionally at least 20 degrees, with a center to center centerline defined from central axis 271 to pivot axis 243 of pivot pin recess 238.

Turning now to FIGS. 18-23, a respective jaw 220 has a jaw base 240, and a jaw extension 242 extending to a remote end 244 having a remote edge 245 of the jaw.

In the illustrated embodiment, jaw extension 242 includes an engagement surface 246 which engages work pieces which are to be manipulated by the tool 200, and first and second side walls 248A, 248B which extend from the engagement surface on opposing sides of the engagement surface. Jaw extension 242 further has a bottom wall 249, a portion of which extends generally parallel to the engagement surface. Side walls 248A, 248B, and bottom wall 249, extend longitudinally along the length of the jaw extension. The side walls extend from locations at or proximate remote end 244 to locations at or proximate a proximal end 250 of engagement surface 246. Bottom wall 249, extends from a location relatively displaced from remote end 244, to a location proximate jaw base 240.

Whereas jaw 20 of the embodiments represented by FIGS. 1-15 has a pair of pivot pin apertures 54A, 54B through wings 52A, 52B, to receive a pivot pin 64, in the embodiments represented by FIGS. 16-27, pivot pin 264 is an integral element of the jaw at jaw base 240. The cross-section of pivot pin 264 is dimensioned only slightly smaller than the cross-section of a pivot pin recess 238, with the profile of pivot pin 264 providing for substantial rotation of the pivot pin about longitudinal pivot pin axis 265 while in a recess 238. The maximum dimension "D1" of pivot pin 264, perpendicular to centerline 241, is greater than the minimum dimension "N" across neck 239 and slightly less than the maximum dimension "D" of the pivot pin recess. Accordingly, pivot pin 264 is assembled to base ring 218 at recess 238 by moving the length of the pivot pin laterally along pivot pin axis 265 and along the thickness of the base ring and into recess 238, thus to the position where the pin is fully inserted as illustrated in FIGS. 21-27.

Figure 18:
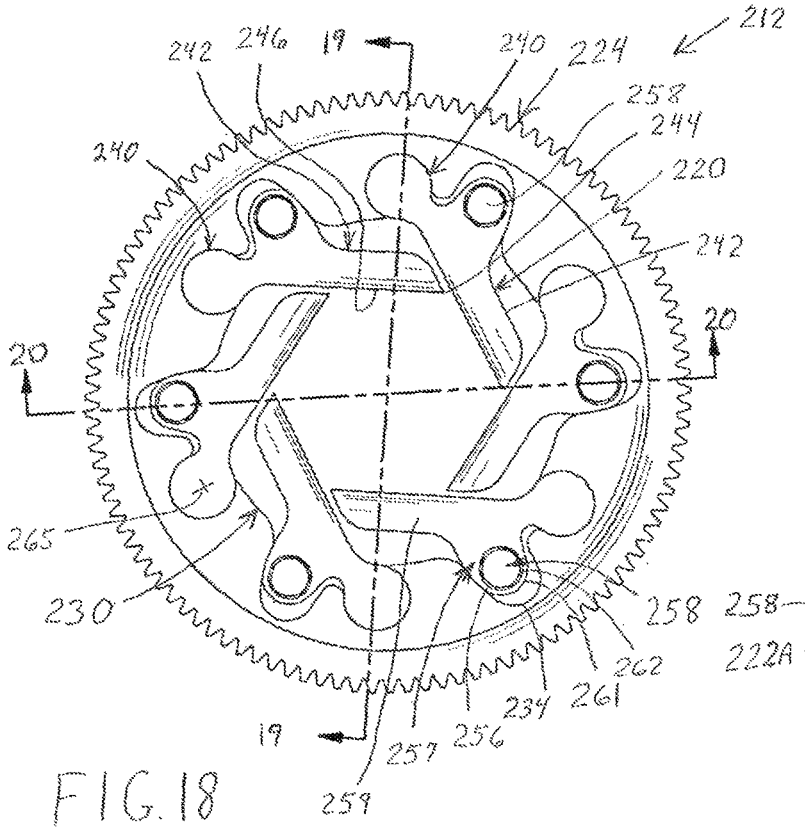
FIG. 18 is a plan view of a third embodiment of jaw subassemblies of the invention, using the base ring of FIGS. 16 and 17 and a second machined, single-piece embodiment of the jaws.
Figure 19:
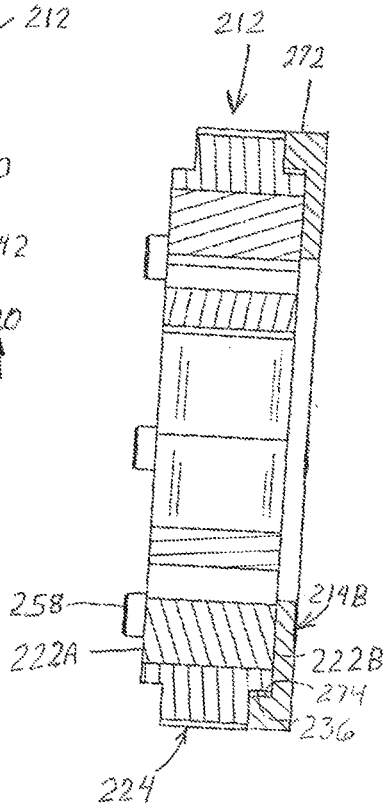
FIGS. 19 and 20 are cross-sections of the jaw subassembly of FIG. 18 taken at 19-19 and 20-20 respectively in FIG. 18.
Figure 20:
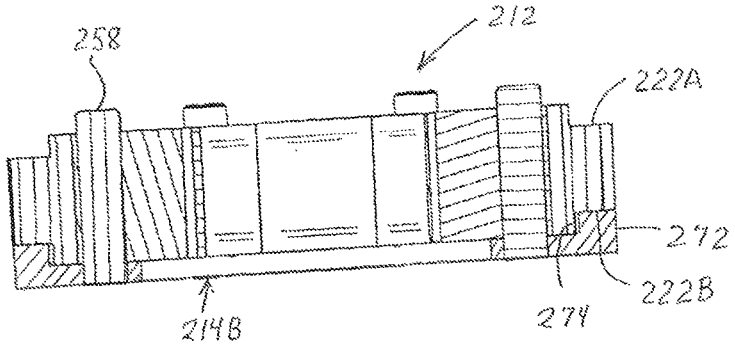
Figure 21:
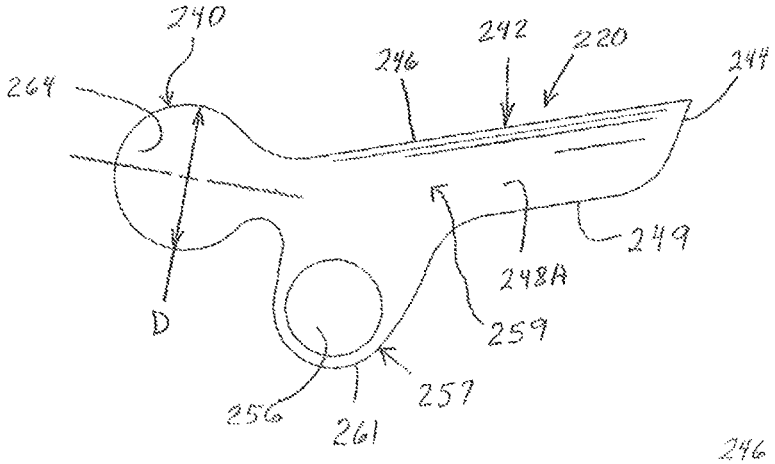
FIG. 21 shows a side elevation view of a third embodiment of jaws of the invention.

Similar to the embodiments represented in FIGS. 1-15, in the embodiments represented by FIGS. 16-27, the jaw includes a cam follower bore 256, which extends through the jaw extension from side wall 248A to side wall 248B to receive a cam follower pin, which is illustrated in e.g. FIGS. 18-20 as a cylindrical pin 258. Cam follower bore 256 is embodied in a lower leg 257 of the jaw which, as illustrated in e.g. FIG. 18, extends down from the main body 259 of the jaw extension. Lower leg 257 has an outer surface 261 which generally conforms to a portion of the inner surface of inner perimeter 230 of the base ring at a respective cam follower recess 234.

Cam follower 258 can be attached to and through bore 256 by any suitable method such as incorporating a pin with an interference fit, adhesive bonding, welding, brazing, soldering, or incorporating other fastener types such as screws and threads, rivets, or any other method to secure the cam follower pin to bore 256 to prevent longitudinal movement of the cam follower pin relative to the jaw, whereby the can follower pin is securely mounted to the respective jaw as illustrated in FIGS. 18-20.

In general, cam follower pin 258 can have an outer surface 262 which defines a cross-section slightly larger than the cross-section of the bore 256 to accommodate an interference fit between cam follower pin 258 and into and through bore 256 whereby the cam follower pin is securely mounted to the respective jaw by frictional engagement. Alternately cam follower pin 258 can have an outer surface 262 which defines a cross-section slightly smaller than the cross-section of the bore 256, just small enough to accommodate insertion of pin 258 into and through bore 256, and where typically a suitable adhesive is applied to either or both of the outer surface 262 of pin 258 or the interior surface of the bore before the pin is inserted into the bore. With the pin in the bore, and upon completion of any curing process for the adhesive, the pin has been bonded to the bore. The bonding of pin 258 to the bore prevents longitudinal movement of the cam follower pin relative to the bore, whereby the cam follower pin is securely mounted to the respective jaw as illustrated in e.g. FIGS. 18-20.

In some embodiments, not shown, the cam follower pin is formed from the same piece of material as the jaw, such that the cam follower pin is part of the unitary object represented by jaw 220.

The configuration of the outer surface 261 of leg 257 is such that, with pivot pin 264 assembled into pivot pin recess 238, leg 257 freely moves into and out of cam follower recess 234 as the jaw is pivoted about pivot pin axis 265 of respective pivot pin 264.

In the jaw subassembly 212 embodiment illustrated in FIGS. 18-20 and 24-27, six jaws 220 are mounted to base ring 218 by respective six pivot pins 264 which are integral with the respective jaws. Thus, the jaw, pivot pin combination illustrated in FIGS. 21-27 is fabricated from a single piece of solid state raw material or is molded from a single flow of fluid material. In the embodiments represented in FIGS. 21-27, opposing ends of the respective pivot pin extend laterally across the width of the jaw only as far as side walls 248A, 248B. In some embodiments, not shown, the length of the pivot pin is less than the width of the jaw between side walls 248A, 248B. In other embodiments, the length of the pivot pin is slightly larger than the width of the pin between side walls 248A, 248B, as in the illustrations in FIGS. 10 and 12.

As in the embodiments represented by FIGS. 1-15, in the embodiments represented by FIGS. 16-27, the cam follower pins 258 extend far enough beyond side walls 248A, 248B to engage cam slots 270 in the respective cover plates 214A, 214B.

Figure 24:
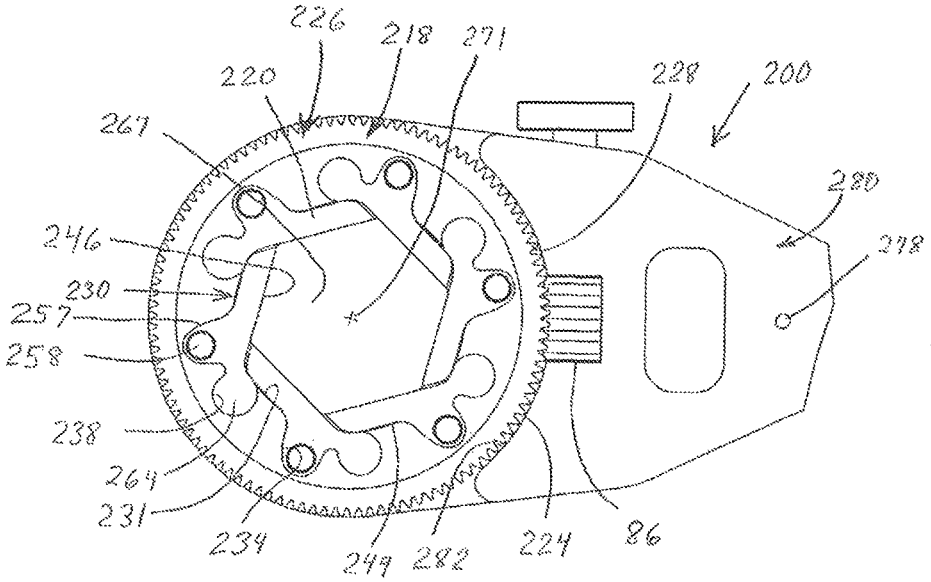
FIG. 24 shows a jaw assembly using the jaw subassembly of FIG. 18, with one of the cover plates removed, and the aperture full open.

With the jaw so mounted to the base ring, for pivotation with respect to a such pivot pin recess 238, the jaw, and thus the jaw engagement surface, is capable of pivoting, from a fully open position, where the cam follower is fully deployed in cam follower recess 234, such as in FIG. 24, to a fully closed position where the jaw, and thus the engagement surface 246 of the jaw, are deployed to the maximum extent possible from the cam follower recess, and the outer surface of leg 257 has moved to a location somewhat displaced from the maximum depth of recess 234, optionally displaced completely out of recess 234.

As illustrated in the drawings, in a jaw subassembly 212, a plurality of jaws 220 are mounted to base ring 218. Any number of two or more jaws can be mounted to the base ring in a given tool. The number of jaws mounted to the base ring depends in part on the configuration of the work pieces to which the tool is expected to be applied as well as the number of recesses 234 and 238. For a simple wrench-type tool of the invention, as few as two jaws can be mounted to the base ring with the engagement surfaces opposing each other, because most nuts, headed bolts, and headed screws have facets, which can be engaged by a wrench-type tool, on opposing sides of the respective fastener/work piece, and most work pieces/heads are 4-sided/4-faceted or 6-sided/6-faceted. Since the majority of the work piece heads are 6-sided, the tool can successfully engage the head even if the tool has only 2 jaws. Similarly, the tool can successfully engage the head if the tool has 3 jaws, namely engaging every other facet on a six-faceted/six-sided work piece head. In the example illustrated in FIGS. 24-27, six jaws 220 are arranged about inner perimeter 230 of base ring 218 whereby the tool can simultaneously engage all six facets of a six-sided/six-faceted nut, bolt, screw, or other work piece.

Each jaw is thus mounted to the base ring at a pivot pin recess 238 by a pivot pin 264 which is an integral element of the jaw. With the jaw thus mounted to the base ring as illustrated in the drawings, with the engagement surface 246 of the jaw facing into the central aperture 267 which extends through the base ring at and inwardly of minor diameter 231, as the jaw is caused to pivot about pivot pin axis 265 at the mounting location at pivot pin 264, the respective cam follower pin 258, and the corresponding jaw leg 257, move into, and outwardly of, the respective cam follower recess 234 in the base ring. Accordingly, all of the plurality of jaws move/pivot, simultaneously and synchronously, about the pivot pin axes 265 of their respective pivot pins 264.

Movement of a respective jaw about its pivot pin axis 265 is controlled by engagement of the respective cam follower pin 258 in a corresponding cam slot 270 in the respective one of head sections 213A, 213B of cover plates 214A or 214B, and subsequent rotation of base ring 218 about its central axis 271.

Similar to the embodiments represented by FIGS. 1, 2, and 5, each cover plate 214A and 214B has a first thickness at its outer edge 272, and a stepped recess 274 having a lesser thickness at a location displaced inwardly from outer edge 272. In the assembled jaw assembly, step recess 274 in the cover plate is generally aligned with a step 236 in the corresponding face 222A or 222B of base ring 218. Accordingly, in the assembled jaw assembly, the respective steps 236, 274 in the base ring and the cover plates maintain the base ring in axial alignment with the cover plates such that cam follower pins 258 in jaws 220 are maintained in proper alignment with cam slots 270 in the respective cover plates.

Figure 25:
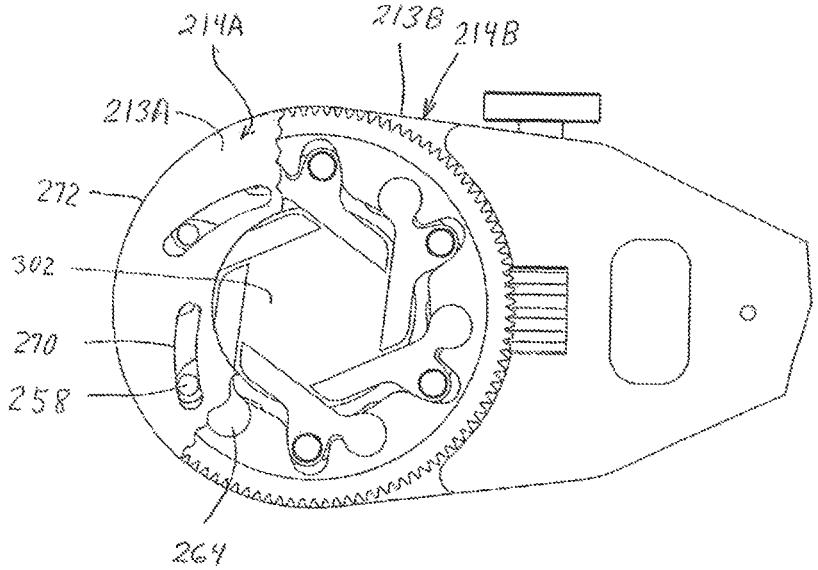
FIG. 25 shows a jaw assembly as in FIG. 24, with the aperture ¾ open.

Referring to FIGS. 21-27, each head section 213A, 213B of a cover plate 214A, 214B has six arcuate cam slots 270 evenly spaced about the circumference of the respective cover plate. Two such slots are shown in FIG. 25. Jaw subassembly 212 has six jaws, correspondingly six cam follower pins 258 extending into, optionally through, the respective six cam slots in each of the head sections.

In the assembled tool, the jaw subassembly is positioned between the two cover plates 214A, 214B, with the cam follower pins mounted in the respective jaws and extending into the respective cam slots of the cover plates.

Any fastener type such as screws, rivets, pins, or fastening means such as welding, brazing, soldering can be used to draw together various handle elements as a single secure unit to thereby define tool handle 81.

As in the embodiments of FIGS. 1-15, screws extend through screw holes 278 in a first handle, through corresponding screw holes 278 in respective first and second handle spacers 280, and are drawn tight by threads in respective threaded holes in a second handle. Given that the two handle elements are rigid extensions of the rigid respective cover plates, the drawing of the two handle elements to each other, with intervening handle spacers, draws the handle elements and the handle spacers together as a single secure unit to thereby define the tool handle. Such drawing together of the handle elements also draws the cover plates toward each other and into working engagement with the jaw subassembly as the steps in the base ring and the head sections become operably engaged with each other.

As with the embodiments represented by FIGS. 5 and 13, the profiles of handle spacers 280 generally correspond to the profiles of the handle elements. Ends 282 of the handle spacers, which are adjacent base ring 218, extend generally parallel to a portion of outer perimeter 224 of base ring 218.

The handle spacers 280 have respective recesses 84, and notches 86. When handle spacers 280 are in facing, touching relationship with each other, with semi-circular elongate recesses aligned with, overlying/underlying each other, in the assembled handle, the combination of the recesses defines a generally circular/cylindrical cavity 87. Recesses 84 extend from one of the sides of the handle into the interior of the handle through the handle spacers. Recesses 84 receive a shaft 88 of a controller 90 which extends outwardly from the respective outer side of the handle, and inwardly into and through a portion of the handle, to an engagement location where a threaded portion 92 of the controller engages the teeth 228 of the base ring.

Notches 86 in the handle spacers receive the threaded portion 92 of shaft 88. The diameter of threaded portion 92, as defined by the maximum diameters at the peaks of respective circumferential threads, is greater than a collective diameter defined by elongate recesses 84. Accordingly, once the handles and handle spacers are assembled to each other, the threaded portion of shaft 88 is captured against longitudinal movement of the shaft, by edges 96 of notches 86.

With the threaded portion captured against longitudinal movement of the shaft, rotation of a thumbwheel 98 of controller 90 rotates threads 100 of the threaded portion against teeth 228 of the base ring, thus rotating the base ring about its longitudinal axis. As the base ring is rotated, jaws 220, which are mounted to the base ring by pivot pins 264, are also caused to rotate. As the jaws move along the direction of rotational movement of the base ring, cam follower pins 258 in the respective jaws engage the respective cam slots 270 in cover plates 214A, 214B. As the cam follower pins engage the cam slots according to the rotation of the base ring, the jaws are caused to pivot about their respective pivot pins axes 265. Such pivoting of the jaws results in concerted, simultaneous movement of the respective jaw extensions, thus the jaw engagement surfaces, toward, or away from, the central axis of opening 302, which corresponds with central axis 271 of the base ring.

FIG. 24 shows the jaw assembly with the bottom walls 249 of the jaws fully retracted against, and in abutting relationship with, the inner perimeter 230 of the base ring at minor diameter 231; at which setting the tool has been opened to its maximum available size. FIG. 25 shows the jaw assembly where controller 90 has been used to rotate base ring 218 so as to further engage the cam follower pins in the cam slots and thereby to further rotate the jaws to a relatively more closed opening 302. Namely, the opening in FIG. 25 has been closed about ¼ to about ⅓ of its available range of movement.

Figure 26:
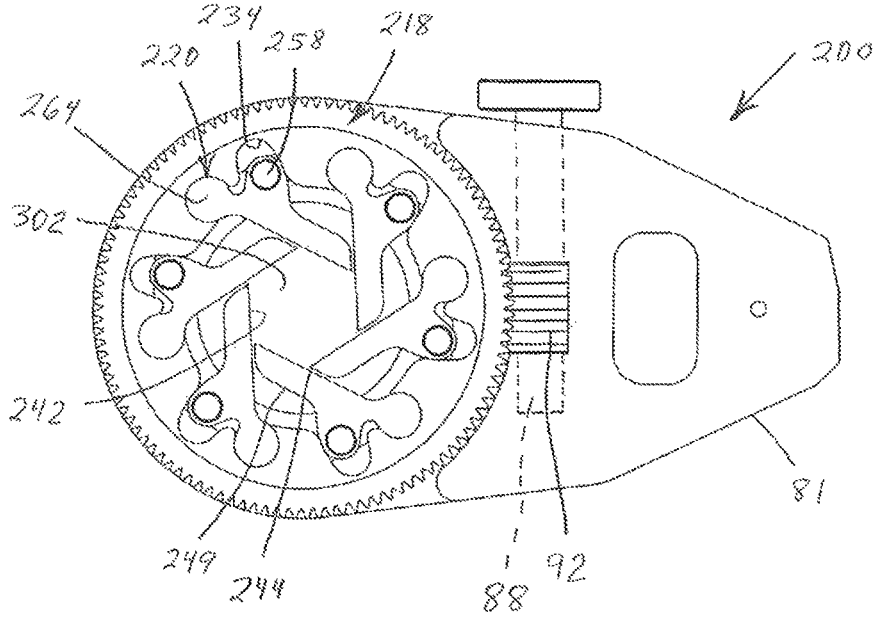
FIG. 26 shows a jaw assembly as in FIGS. 24 and 25, with the aperture ½ open.

FIG. 26 shows a further closure of the jaws, to about ½ closure. Still further rotation of thumb wheel 98 results in still further closer of jaws 220 thus to further reduce the size of opening 302 as defined by jaws 220. Full range of closure is reached when cam follower pins 258 reach the ends of cam slots 270. Range of movement can be further extended by either extending slots 270 or by increasing the angle by which the slots deviate from a given radius about axis 271.

The direction of movement of the jaws, toward or away from central axis 271, depends on whether the thumbwheel is turned clockwise or counter-clockwise. Thus, as the thumbwheel is turned one direction, opening 302 becomes larger. As the thumbwheel is turned in the opposite direction, opening 302 becomes smaller.

Figure 22:
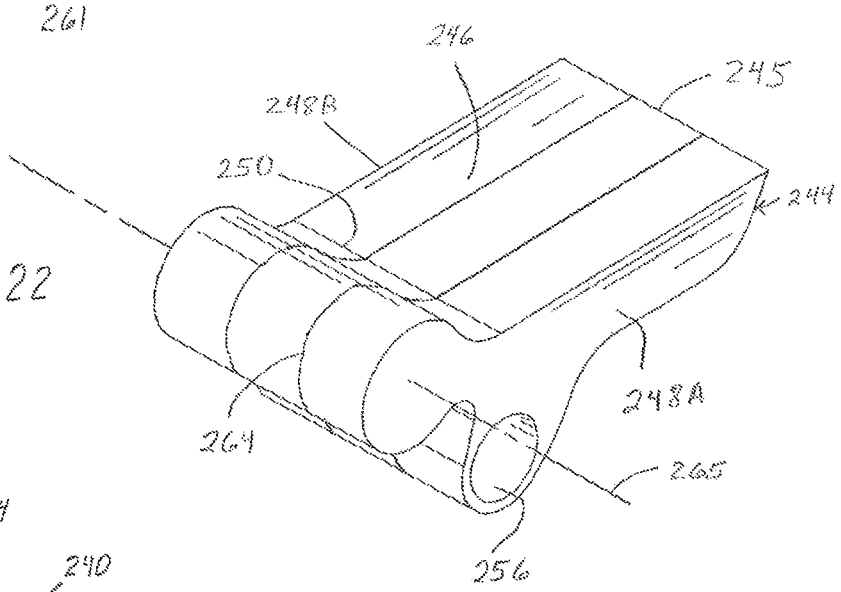
FIGS. 22-23 show pictorial views of the jaw of FIG. 21, illustrating that jaws fabricated using multiple jaw elements.
Figure 23:
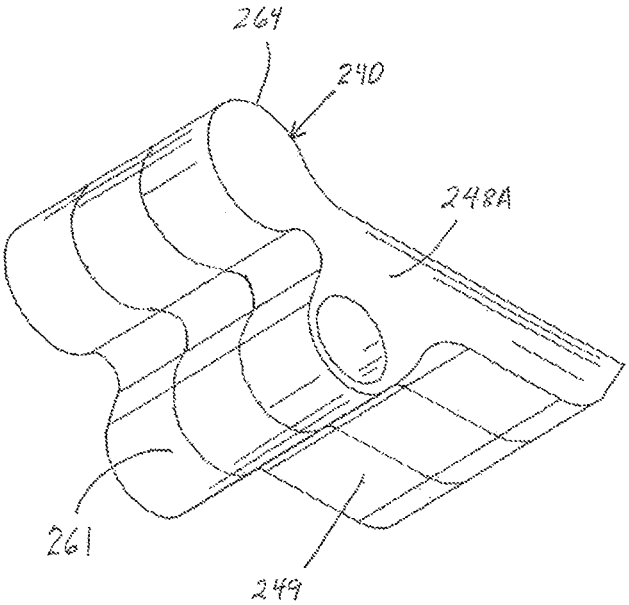

As illustrated, a jaw 220 shown in FIGS. 18-27 is formed as a single piece of material in the shape shown, or is cut or machined from a previously formed piece of material, without substantial deformation of the work piece. A jaw embodiment shown in FIG. 22 is contemplated whereby jaws 220 can be formed by combining at least two layers of a previously-formed work piece such as flat metal sheet stock in coincident alignment with each other into an equivalent single piece jaw by methods such as bonding, spot welding, brazing, soldering, and fastening, among others. By contrast, jaw 20 of the embodiments of e.g. FIGS. 1-15 is formed by, among other operations, bending or otherwise deforming a previously-formed work piece such as flat metal sheet stock. Thus, jaws of the invention can be formed by methods including being machined, cut, forged, molded, cast, sintered, or stamped, among others, for example Jaw formed by bending (FIGS. 1-15), or Jaw formed by not bending (FIGS. 16-27).

The handle inserts and controller illustrated in FIGS. 1-15 can be used with the embodiments of the invention illustrated in FIGS. 16-27. Accordingly, the same numbers are used in describing the handle inserts and the controller in FIGS. 16-27.

Figure 28:
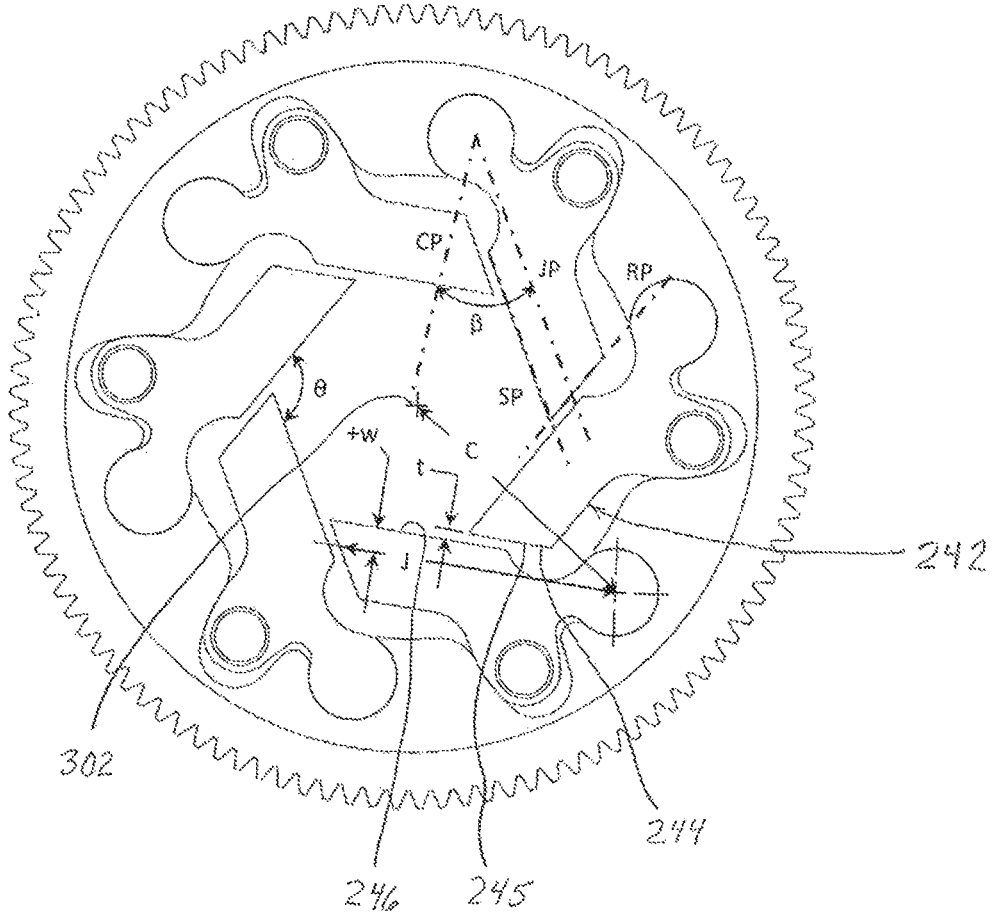
FIG. 28 is a plan view of a jaw subassembly illustrated in FIG. 27, and showing the dimensions representative of the equation for distance "t".

FIGS. 27 and 28, along with the accompanying description here, illustrate the ongoing dynamic relationships of the jaws to each other to define an adjustable sized jaw opening as an effective equi-angular polygon having internal angles "θ" formed by the collective engagement surfaces 46, 246 of jaws 20, 220, each engagement surface being defined by a respective engagement surface plane "SP" that is parallel to the central axis 71, 271 and is coincident with, passes through, or at least contacts, the engagement surface of the respective jaw extension, and where the size of opening 102, 302 changes in response to the adjustment rotations of controller 90 at thumb wheel 98. FIG. 28 shows clearance distance "t" between a remote end 244 of a first jaw extension 242 and a next adjacent engagement surface 246 of the jaw extension on a next adjacent second one of the jaws. Remote plane "RP" is parallel to the central axis and contacts the remote edge 245 of the first jaw the remote edge being that portion of the remote end that is most proximate plane "SP" of the jaw extension on the next adjacent second one of the jaws, the remote end of the first jaw in FIG. 28 being parallel to jaw extension plane "SP" of the second jaw. As illustrated, remote plane "RP" is parallel to plane "SP" of the jaw extension on a next adjacent second one of the jaws. A plane "JP" is parallel to plane "SP" of a given jaw and passes through the pivot axis of the respective jaw. A center to center plane "CP" passes through both the central axis of the jaw opening 102, 302 and the pivot axis of a given jaw. An angle "β" is defined between plane "JP" and the center to center plane "CP" of a respective jaw, within a common unnamed plane which is perpendicular to both plane "JP" and plane "CP". A first such jaw has a jaw length "J" along the plane "JP" defined as the distance perpendicular to the pivot axis of a given jaw to plane "RP" on the remote end 44, 244 of the given jaw. A center to center distance "C" extends a radial distance between the central axis and the jaw pivot axis of the respective jaw. A width "w" is the perpendicular distance between plane "JP" and plane "SP" on a given jaw. Clearance distance "t" is the perpendicular distance between remote plane "RP" of a first jaw that is most proximate plane "SP" of the jaw extension on a next adjacent second one of the jaws. For a hexagonal array of six jaws, the shortest distance "t" between plane "RP" of the jaw extension on a first jaw and a proximate plane "SP" on the adjacent second jaw varies with angle β according to the equation:

$$t = C\sin(60^\circ + \beta) - \frac{\sqrt{3}}{2}J - w.$$

According to the above equation, the magnitude of the distance "t" is smallest at the full open positions of the jaws and again at the full closed positions of the jaws. Still referring to the equation, as the jaws move through a jaw operating range from the full open position to the full closed position, the distance "t" increases, reaches a maximum, and then decreases as the jaws again approach the opposing full open or full closed position. The equation shows that the jaw length "J", width "w", and the center-to-center distance "C" are selected to determine the desirable jaw operating range. The work opening range from a minimum work opening to a maximum work opening is at least a portion of the jaw operating range and is determined by the length of the elongate cam slot 270 of at least one actuator. The width "w" accounts for the value of "t" depending on the relative positions of planes "JP and "SP". It is desirable that the distance "t" is, in any position, relatively small as to substantially engage the entirety of the working surface of the facets of the workpiece.

Figure 29A:
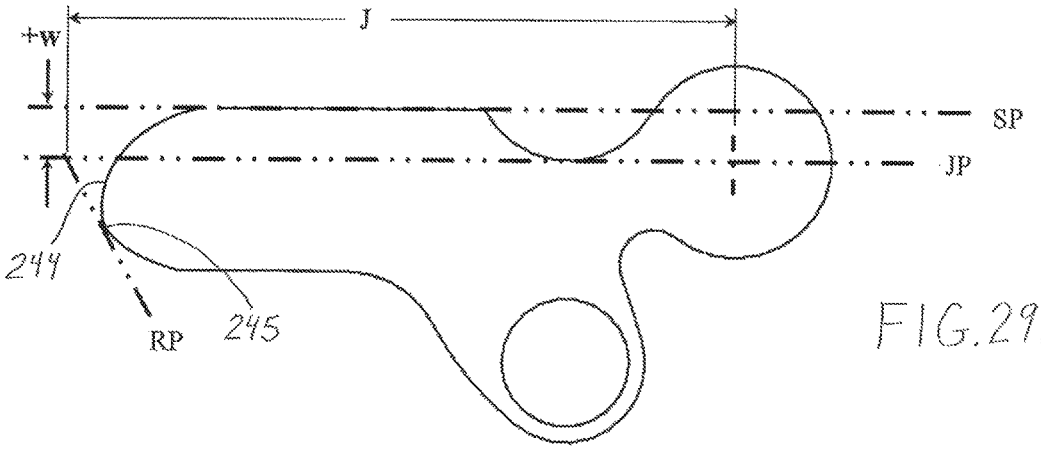
FIGS. 29A, 29B, and 29C are side elevation views of fourth, fifth, and sixth embodiments of the jaws, illustrating three different variations of width "w" and three different variations of the profile of the end of a jaw.
Figure 29B:
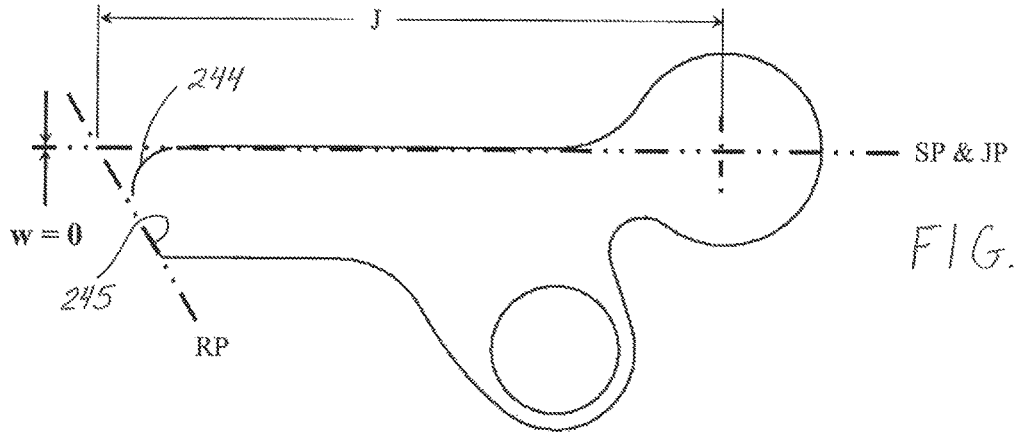
Figure 29C:
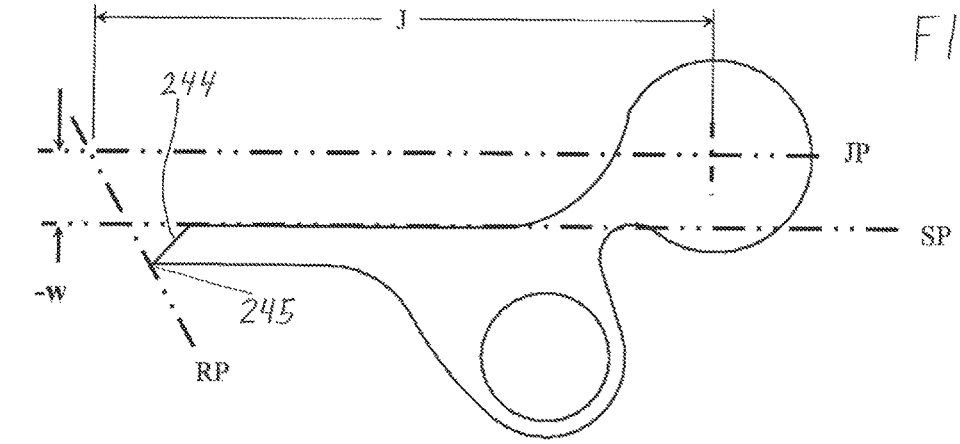

FIGS. 29A-29C illustrate three different variations of variable "w", along with three different examples of the many possible configurations of the outer surface of the end profile of the jaw extension in the vicinity of remote end 245. FIG. 29A shows "w" as a positive dimension relative to plane "JP". FIG. 29B shows "w" as coincident with plane "JP" and therefore having a value of zero. FIG. 29C shows "w" as having a negative dimension relative to plane "JP".

As used herein, the phrase "remote end" of the jaw is that portion of the jaw which connects the top of the jaw extension 42, 242 at engagement surface 46, 246 with the bottom 49, 249 of the jaw extension at the surface of the jaw which is remote from the pivot pin aperture 54A, 54B or the pivot pin 264.

As used herein, and as illustrated in FIGS. 29A-29C, the phrase "remote edge" means that portion of the remote end of the jaw which contacts plane "RP".

In any of the embodiments, jaw lengths can be selected such that the jaws touch each other at the full open and full closed positions. Because the distance "t" is relatively small at any jaw position, when the tool applies torque to a work piece, even small deflections of the jaws in response to such torque can bring the remote ends 44, 244 of the jaws into contact with the adjacent jaw engagement surfaces such that the jaws operate to distribute the force of the torque among themselves whereby all of the jaws experience approximately the same force even if some of the jaws experience greater or lesser amounts of force being received from the facets of the work piece.

Pivotation of the jaws about the pivot pin axis 65, 265 of pivot pins 64, 264 results in arcuate motion of the jaws about the respective pivot pin axis. As illustrated in FIGS. 21-27, pivot pin 64, 264 can be an integral element of a one-piece jaw; e.g. where the jaw and jaw pin collectively are made from a single work piece.

Tools of the invention engage a work piece in a manner which effectively matches the configuration of the work piece, sufficient to eliminate, or at least limit, potential for deformation of the work piece as the tool is operating on the work piece.

Tools of the invention can engage the work piece at equally spaced locations about the work piece such that the engagement applies force at generally symmetrically balanced locations about the perimeter of the work piece, such that the work piece experiences generally balanced force increments about the perimeter of the work piece contact surface, corresponding to the number of jaws being applied to the facets of the work piece.

Employing the combination of the base ring, where the cam follower recess is defined by a portion of the inner perimeter of the base ring, results in a tool where the ratio of maximum-work opening/minimum-work opening, where such work opening is measured as the perpendicular distance between the engaging surfaces 246 of opposing jaws 220, namely the ratio of the maximum size work opening 302 to the minimum size work opening 302, is greater than 1/1, optionally greater than 1.5/1, optionally greater than 2/1.

In addition, the ratio of the maximum outside tool dimension defining the work space, at head sections 13A, 13B, 213A, 213B, to the maximum work opening 102, 302 is no greater than 2.75/1.

Each of the two cover plates 14A, 14B, 214A, 214B can be a single piece/element, or can be two pieces connected to each other by one or more connectors, fasteners, such as a head section connected to a handle element.

The tool, with a head section and connecting handle elements, can be constructed with fewer than two cover plates, fewer than two handle spacer pieces, by methods such as molding, casting, sintering, forging, cutting, or stamping, or combinations of the above, to form a single secure unit to thereby define tool handle 81.

Although the invention has been described with respect to various embodiments, the invention is also capable of a wide variety of further and other embodiments within the spirit and scope of the appended claims.

Those skilled in the art will now see that certain modifications can be made to the apparatus and methods herein disclosed with respect to the illustrated embodiments, without departing from the spirit of the instant invention. And while the invention has been described above with respect to certain preferred embodiments, the reader will readily understand that the invention is adaptable to numerous rearrangements, modifications, and alterations, and all such arrangements, modifications, and alterations are intended to be within the scope of the appended claims.

To the extent the following claims use means plus function language, it is not meant to include there, or in the instant specification, anything not structurally equivalent to what is shown in the embodiments disclosed in the specification.

Having thus described the invention, what is claimed is:

1. A jaw subassembly, adapted to be used as part of a jaw assembly, said jaw subassembly comprising:

(a) a base ring, having first and second opposing faces, a first outer perimeter of said base ring extending between the first and second opposing faces, a base ring aperture being disposed inwardly of the outer perimeter, the base ring aperture having an inner perimeter and a central longitudinal axis; and (b) a plurality of jaws, each said jaw having a jaw base, and a jaw extension displaced from the respective said jaw base, each said jaw being connected to said base ring by a pivot pin such that the respective said jaw can pivot about the respective said pivot pin at a respective jaw pivot axis, at least one cam follower recess being defined by the inner perimeter of said base ring.

2. A jaw subassembly as in claim 1, each said jaw extension comprising:

an engagement surface defining a plane "SP" that is parallel to the central longitudinal axis of the aperture and is coincident with at least a central portion of the engagement surface of the respective jaw extension, a plane "JP" parallel to plane "SP" and passing through the pivot axis of the respective jaw, a remote end, a remote plane "RP" parallel to the pivot axis of a next adjacent second jaw and contacting that portion of the remote end of the first jaw that is most proximate the plane "SP" of the jaw extension on the next adjacent second jaw the remote plane "RP" being parallel to said jaw extension plane "SP" of the second jaw, a center to center plane "CP" contacting both the central longitudinal axis and the pivot axis of the respective said jaw, an angle "β" being defined from a first leg thereof at plane "JP" to a second leg thereof at center to center plane "CP" of a respective jaw within a perpendicular common plane, a jaw length "J" extending along the respective plane "JP" perpendicular to the pivot axis of the respective jaw, to plane "RP" on the remote end of the respective said jaw, a center to center distance "C" extending radially between the central longitudinal axis and the pivot axis of the respective said jaw, a width "w" defining a perpendicular distance between plane "JP" and plane "SP" of a respective jaw, a clearance distance "t" representing a shortest distance between plane "RP" of the jaw extension on a first said jaw and plane "SP" of a next adjacent second said jaw, and for a hexagonal array of six jaws, the distance "t" is defined according to the equation:

$$t = C\sin(60^\circ + \beta) - \frac{\sqrt{3}}{2}J - w$$

the engagement surfaces of said plurality of jaws collectively defining, in the aperture, an adjustable size jaw opening.

3. A jaw subassembly as in claim 1, a plurality of cam follows recesses being defined by portions of the inner perimeter of said base ring.

4. A jaw subassembly as in claim 3, the inner perimeter of said base ring further comprising a plurality of pivot pin recesses.

5. A jaw subassembly as in claim 4, the pivot pin recesses being alternately spaced between respective ones of the cam follower recesses.

6. A jaw subassembly as in claim 3 wherein a said pivot pin is an integral element of a respective one of said jaws.

7. A jaw subassembly as in claim 1, further comprising a plurality of pivot pin holes spaced about a circumference of said base ring and extending through said base ring from the first face to the second opposing face.

8. A jaw subassembly as in claim 1, a plurality of pivot pin recesses being defined by portions of the inner perimeter of said base ring, said pivot pin recesses being spaced about the inner perimeter and extending through said base ring from the first face to the second opposing face.

9. A jaw subassembly as in claim 8 wherein a said pivot pin is an integral element of a respective one of said jaws.

10. A jaw subassembly as in claim 9, a given one of the pivot pin recesses having a main body, and a neck, a minimum dimension "N" across the neck being less than a maximum dimension "D" of the pivot pin recess across the main body perpendicular to a line which passes through the neck and bisects both the neck and the main body into equal portions.

11. A jaw subassembly as in claim 10, a center line which passes from an interior of the pivot pin recess through a pivot axis of a pivot pin which closely fits the pivot pin recess and which also passes through the neck of the pivot pin recess, and which bisects both the pivot pin recess and the neck into equal portions, defines an angle α of at least 10 degrees with a radius of said base ring, the radius intersecting the pivot axis of such pivot pin in the pivot pin recess.

12. A jaw subassembly as in claim 1 wherein a said pivot pin is an integral element of a respective one of said jaws.

13. A jaw assembly comprising a jaw subassembly as in claim 1, said jaw assembly being adjustable between a minimum size jaw opening and a maximum size jaw opening, which enables said jaw subassembly to be applied to any work piece having any size in a range between the minimum size jaw opening and the maximum size jaw opening, said plurality of jaws thus defining an adjustable size work opening, said jaw assembly further comprising (c) an actuator covering at least a portion of one of the first and second opposing faces of said base ring, and extending about, and generally outwardly from, at least a portion of the inner perimeter of the base ring aperture;

(d) one or more bridges connecting said jaws to said actuator such that movement of said base ring relative to said actuator causes said jaws to pivot about said pivot axes of the respective said jaw such that said jaw extensions move in concert with each other, generally inwardly thereby reducing the size of the work opening, or generally outwardly thereby expanding the size of the work opening, depending on direction of movement of said base ring; and (e) a plurality of elongate cam slots, the one or more bridges comprising respective one or more cam followers connecting the jaws to the cam slots by a slidable interaction between a cam follower and the actuator along an elongate cam slot.

14. The jaw assembly of claim 13, the actuator being defined in at least one cover plate, the jaw assembly comprising "n" jaws, and the one or more bridges comprising "n" bridges connecting the jaws to the at least one cover plate, where "n" is a finite integer.

15. A jaw assembly as in claim 14, said base ring comprising a first set of teeth in the outer perimeter of said base ring, and said controller comprising an adjusting screw comprising a second set of teeth engaging said first set of teeth.

16. A jaw assembly as in claim 15 wherein said second set of teeth directly engages said first set of teeth.

17. A jaw assembly as in claim 15, said first and second sets of teeth comprising a self-locking gear set.

18. A jaw assembly as in claim 13 wherein said actuator covers at least a portion of said jaw base of each said jaw.

19. The jaw assembly of claim 13, the plurality of jaws comprising "n" jaws, and the one or more bridges comprising "n" bridges, each bridge connecting a different jaw to the actuator, where "n" is a finite integer.

20. A jaw assembly as in claim 13, further comprising a second actuator covering the other of the first and second faces of said base ring, and extending about, and generally outwardly from, at least a portion of the inner perimeter of the base ring aperture.

21. A jaw assembly as in claim 13, further comprising a said bridge interfacing with a said jaw between the respective said jaw base and the respective said jaw extension.

22. A jaw assembly as in claim 13, further comprising a plurality of elongate cam slots in said actuator, said one or more bridges comprising respective one or more cam followers connecting said jaws to said cam slots.

23. A jaw assembly as in claim 13, each said jaw extension comprising an engagement surface, and wherein a range of motion of said jaws has an adjustability ratio, of maximum jaw work opening to minimum jaw work opening, greater than 1/1, where such work opening is measured as a perpendicular distance between the engagement surfaces of opposing ones of said jaws.

24. A jaw assembly as in claim 13, each said jaw extension comprising an engagement surface, and wherein a range of motion of said jaws has an adjustability ratio, of maximum jaw work opening to minimum jaw work opening, greater than 1.5/1, where such work opening is measured as a perpendicular distance between the engagement surfaces of opposing ones of said jaws.

25. A jaw assembly as in claim 13, each said jaw extension comprising an engagement surface, and Wherein a range of motion of said jaws has an adjustability ratio, of maximum jaw work opening to minimum jaw work opening, of at least 2/1, where such work opening is measured as a perpendicular distance between the engagement surfaces of opposing ones of said jaws.

26. A jaw assembly as in claim 13, further comprising a plurality of elongate cam slots, said one or more bridges comprising respective one or more cam followers connecting the jaws to the cam slots by sliding interaction between a said bridge and said actuator along an elongate such cam slot.

27. A jaw assembly as in claim 26, further comprising a controller (i) moving said base ring about the central axis and relative to said actuator from a first position to a second position, thereby causing said jaws to pivot inwardly or outwardly thereby to adjust the size of the work opening, and (ii) holding said base ring in the second position.

28. A jaw assembly comprising a jaw subassembly as in claim 1, said jaws being arranged to rotate synchronously about the respective jaw pivot axis, whereby said jaws cooperate with each other in rotating between a maximum jaw opening and a minimum size jaw opening.

29. A jaw assembly comprising the jaw subassembly of claim 1, adjustable between a minimum size jaw opening and a maximum size jaw opening, which enables said jaw assembly to be applied to any work piece having any size in a range between the minimum size jaw opening and the maximum size jaw opening, said plurality of jaws thus defining an adjustable size work opening, said jaw assembly further comprising an actuator covering at least a portion of one of the first and second opposing faces of said base ring, and extending about, and generally outwardly from, at least a portion of the inner perimeter of the base ring aperture, said actuator comprising a plurality of elongate cam slots;

one or more cam followers connecting said jaws to the cam slots by slidable interactions between said one or more cam followers and said actuator along the elongate cam slots, which causes said jaws to pivot about the respective pivot pin axes of respective said pivot pins such that said jaw extensions move in concert with each other, generally inwardly thereby reducing the size of the work opening, or generally outwardly thereby expanding the size of the work opening; and a controller that (i) effects rotation of said base ring relative to said actuator from a first position to a second position, thereby to cause said jaws to pivot inwardly or outwardly thereby to adjust the size of the work opening, and (ii) holds said base ring in the second position.

30. A jaw assembly as in claim 29 wherein a said pivot pin is an integral element of a respective one of said jaws.

31. A tool comprising a jaw assembly as in claim 15, said tool further comprising a single handle extending from said jaw assembly, a rotating drive of said adjusting screw extending from said single handle.

32. A tool as in claim 31, further comprising a second actuator covering at least a portion of the other of the first and second faces of said base ring, and extending about an entirety of the base ring aperture, and extending generally outwardly from the inner perimeter of the base ring aperture, said single handle comprising extensions of said first and second actuators extending in one or more common directions from said jaw assembly, at least one handle spacer being disposed in said handle between said extensions of said first and second actuators.

33. A tool as in claim 32, further comprising a second cover plate, said first and second cover plates overlying said first and second opposing faces of said base ring, said first and second actuators being defined in first and second head sections of said first and second cover plates, said extensions of said first and second actuators comprising first and second handle elements of said first and second cover plates, said first and second handle elements being secured to each other, with said at least one handle spacer between said first and second handle elements, in at least first and second locations spaced from each other so as to generally prevent movement of said first and second cover plates and said handle spacer relative to each other during use of said tool.

34. A tool as in claim 26, further comprising a second actuator covering at least a portion of the other of the first and second faces of said base ring, said first and second actuators being defined in first and second head sections of first and second cover plates, said single handle comprising first and second handle elements of said first and second cover plates, extending from said first and second head sections, and at least one handle spacer disposed between said first and second handle elements, said at least one handle spacer confining said second set of teeth against said first set of teeth.

35. A tool comprising a jaw assembly, said jaw assembly comprising a jaw subassembly as in claim 10, a single handle extending from said jaw assembly.

36. A tool comprising a jaw assembly, said jaw assembly comprising a jaw subassembly as in claim 11, a single handle extending from said jaw assembly.

37. A tool comprising the jaw assembly of claim 29, a single handle extending from said jaw assembly.

38. A tool comprising a jaw assembly as in claim 13, each said jaw comprising an engagement surface, further comprising a second actuator covering at least a portion of the other of the first and second faces of said base ring, and a second cover plate, said first and second cover plates overlying said first and second opposing faces of said base ring, said first and second actuators being defined in first and second head sections of said first and second cover plates, a single handle extending from said jaw assembly, said tool having a maximum outside tool dimension defining a work space at the head sections exclusive of any contribution of said handle, a ratio of maximum outside tool dimension to a maximum size effective work opening, the maximum work opening being measured as a maximum diameter of a circle inscribed within a polygon formed by the engagement surfaces of the plurality of jaws, of no greater than 2.75/1.

39. A tool comprising a jaw assembly as in claim 13 wherein the controller is adapted to being manipulated by a user's hand while the same hand is used to simultaneously hold the tool.

* * * * *